US009982898B2

(12) United States Patent
Yamada et al.

(10) Patent No.: US 9,982,898 B2
(45) Date of Patent: May 29, 2018

(54) INDOOR UNIT OF AIR CONDITIONER AND AIR CONDITIONER INCLUDING A HEAT EXCHANGER ON A DOWNSTREAM SIDE OF A BLOWER

(75) Inventors: Shoji Yamada, Tokyo (JP); Kenichi Sakoda, Tokyo (JP); Masao Akiyoshi, Tokyo (JP); Akira Takamori, Tokyo (JP); Nobuaki Uehara, Tokyo (JP); Tomoya Fukui, Tokyo (JP); Seiji Nakashima, Tokyo (JP); Naoki Iwamoto, Tokyo (JP); Satoshi Michihata, Tokyo (JP); Isao Otsuka, Tokyo (JP); Masayuki Tsuji, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1119 days.

(21) Appl. No.: 13/144,220

(22) PCT Filed: Oct. 2, 2009

(86) PCT No.: PCT/JP2009/067265
§ 371 (c)(1),
(2), (4) Date: Aug. 5, 2011

(87) PCT Pub. No.: WO2010/089920
PCT Pub. Date: Aug. 12, 2010

(65) Prior Publication Data

US 2012/0018117 A1 Jan. 26, 2012

(30) Foreign Application Priority Data

Feb. 5, 2009 (JP) ..... 2009-24788
May 18, 2009 (JP) ..... 2009-119680

(51) Int. Cl.
*F24F 13/24* (2006.01)
*F24F 1/00* (2011.01)
(Continued)

(52) U.S. Cl.
CPC ..... *F24F 1/0007* (2013.01); *F24F 13/24* (2013.01); *F24F 13/30* (2013.01); *F24F 1/0029* (2013.01);
(Continued)

(58) Field of Classification Search
CPC ..... F24F 1/0007; F24F 1/0011; F24F 1/0029; F24F 1/0059; F24F 13/08; F24F 13/081;
(Continued)

(56) References Cited

U.S. PATENT DOCUMENTS 6,378,605 B1 * 4/2002 Kutscher ..... F28B 1/06 165/181
7,216,501 B2 * 5/2007 Terada ..... F24F 1/0007 62/285

FOREIGN PATENT DOCUMENTS

CN 1137626 A 12/1996
JP 48 1941 1/1973
(Continued)

OTHER PUBLICATIONS

Japanese Office Action dated Jun. 3, 2014 in Patent Application No. 2013-079569 with English Translation.
(Continued)

*Primary Examiner* — Grant Moubry
*Assistant Examiner* — Harry Arant
(74) *Attorney, Agent, or Firm* — Oblon, McClelland, Maier & Neustadt, L.L.P.

(57) ABSTRACT

An indoor unit includes a casing having a suction port formed in an upper part and a blow-out port formed on a lower side at a front face part, an axial-flow or diagonal-flow
(Continued)

fan provided on the downstream side of the suction port in the casing, and a heat exchanger provided on the downstream side of the fan and on the upstream side of the blow-out port in the casing, in which air blown out of the fan and refrigerant are heat-exchanged.

17 Claims, 15 Drawing Sheets

(51) Int. Cl.
*F24F 13/30* (2006.01)
*F28D 20/00* (2006.01)

(52) U.S. Cl.
CPC ..... *F24F 1/0059* (2013.01); *F24F 2013/247* (2013.01); *F28D 2020/0013* (2013.01)

(58) Field of Classification Search
CPC ..... F24F 13/24; F24F 13/30; F24F 2013/24; F24F 2013/247
USPC ..... 165/11.1, 104.34, 120, 122
See application file for complete search history.

(56) References Cited

FOREIGN PATENT DOCUMENTS

| | | | | |
|---|---|---|---|---|
| JP | 50 75544 | | 7/1975 | |
| JP | 53 51644 | | 5/1978 | |
| JP | 60-156315 | U | 10/1985 | |
| JP | 2 34421 | | 2/1990 | |
| JP | 04 281125 | | 10/1992 | |
| JP | 5 1914 | | 1/1993 | |
| JP | 07 110143 | | 4/1995 | |
| JP | 2000 329364 | | 11/2000 | |
| JP | 2000329364 | A * | 11/2000 | ..... F24F 1/00 |
| JP | 2001 21172 | | 1/2001 | |
| JP | 2001 221497 | | 8/2001 | |
| JP | 2004 53235 | | 2/2004 | |
| JP | 2004245481 | A * | 9/2004 | |
| JP | 2005 3244 | | 1/2005 | |
| JP | 2005003244 | A * | 1/2005 | ..... F24F 1/00 |
| WO | WO 2007069507 | A1 * | 6/2007 | ..... F24F 1/0007 |

OTHER PUBLICATIONS

International Search Report dated Oct. 27, 2009 in PCT/JP09/067265 filed Oct. 2, 2009.
Office Action dated Jun. 24, 2014 in Chinese Patent Application No. 2009801561655 (with English language translation).
Combined Office Action and Search Report dated Dec. 10, 2013 in Chinese Patent Application No. 200980156165.5 with English translation and English translation of categories of cited documents.
Australian Patent Examination Report dated Jul. 26, 2012, in Australian Patent Application No. 2009339555.
Combined Chinese Office Action and Search Report dated Apr. 12, 2013 in Patent Application No. 200980156165.5 (with English translation and English translation of Categories of Cited Documents).
Japanese Office Action dated Feb. 5, 2013 in Patent Application No. 2010-549345 with English Translation.
Office Action dated Nov. 26, 2013 in Japanese Patent Application No. 2013-079569 (with English translation).
Partial European Search Report dated Mar. 17, 2015 in European Patent Application No. 09839694.8.
Extended Search Report dated Jul. 2, 2015 in European Patent Application No. 09839694.8.
Office Action dated Jul. 17, 2017 in Indian Patent Application No. 5080/CHENP/2011.
Communication dated Feb. 20, 2017 in European Patent Application No. 09839694.8.
Communication dated Oct. 12, 2017 in European Patent Application No. 09839694.8.

* cited by examiner

INDOOR UNIT OF AIR CONDITIONER AND AIR CONDITIONER INCLUDING A HEAT EXCHANGER ON A DOWNSTREAM SIDE OF A BLOWER

TECHNICAL FIELD

The present invention relates to an indoor unit in which a fan and a heat exchanger are stored in a casing (indoor unit) and an air conditioner provided with this indoor unit.

BACKGROUND ART

There has been an air conditioner in which a fan and a heat exchanger are stored in a casing. As such an air conditioner, an "air conditioner comprising a main body casing having an air inlet and an air outlet and a heat exchanger disposed in the main body casing, in which a fan unit constituted by providing a plurality of small-sized propeller fans attached in a width direction of said air outlet is disposed at said air outlet" is proposed (See Patent Document 1, for example). With this air conditioner, the fan unit is disposed at the air outlet so as to facilitate directional control of an air current and the fan unit with the same configuration is also provided at a suction port so that heat exchange performance is improved by increase in an air volume.

PRIOR ART REFERENCES

Patent Document

Patent Document 1: Japanese Unexamined Patent Application Publication No. 2005-3244 (paragraph 3, lines 63 to 87, FIGS. 5 and 6)

DISCLOSURE OF INVENTION

Problems to be Solved by the Invention

A heat exchanger as in Patent Document 1 is provided on the upstream side of the fan unit (blower). Since a movable fan unit is provided on the air outlet side, drop in the air volume, back flow and the like are caused by a change in an air passage accompanying fan moving and instability in a flow due to asymmetric suctioning. Moreover, air with disturbed flow might flow into the fan unit. That is, the flow of air flowing into an outer periphery portion of a propeller of the fan unit where a flow velocity becomes faster is disturbed, and the fan unit itself becomes a noiseource (causing deterioration in noise), which is a problem.

The present invention was made to solve the above-mentioned problems and has an object to provide an indoor unit of an air conditioner that can suppress noise better than the prior-art air conditioner and an air conditioner provided with this indoor unit.

Means for Solving the Problems

An indoor unit of an air conditioner according to the present invention is provided with a casing in which a suction port is formed in an upper part and a blow-out port is formed in a lower part on a front face portion, an axial-flow or diagonal-flow blower provided on the downstream side of the suction port in the casing, and a heat exchanger provided on the upstream side of the blow-out port, which is on the downstream side of the blower in the casing, to perform heat exchange between air blown out from the blower and a refrigerant.

Also, the air conditioner according to the present invention is provided with the above-mentioned indoor unit.

Advantages

In the present invention, since the blower is provided on the upstream side of the heat exchanger, the flow of air flowing into the blower has fewer disturbances. Thus, noise generated from the blower can be suppressed. Therefore, the indoor unit of the air conditioner that can suppress noise better than the prior-art air conditioner and the indoor unit can be obtained.

BEST MODES FOR CARRYING OUT THE INVENTION

Embodiments of the present invention will be described below based on the attached drawings.

Embodiment 1

Figure 1:
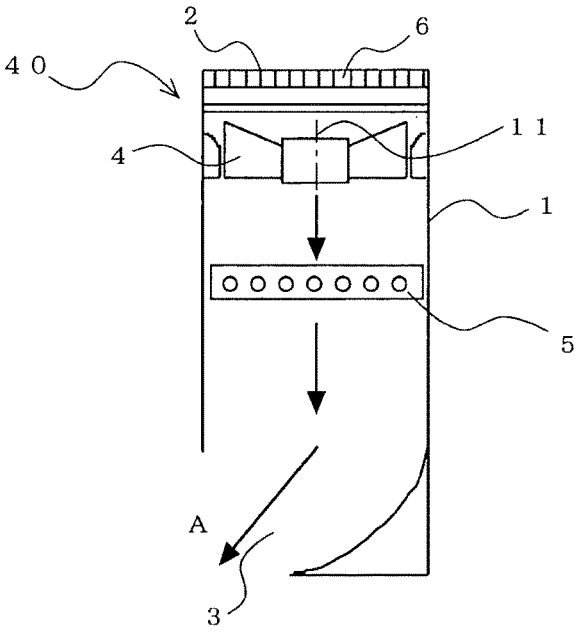
FIG. 1 is a longitudinal sectional view illustrating an example of an indoor unit of an air conditioner according to Embodiment 1.

FIG. 1 is a longitudinal sectional view illustrating an example of an indoor unit (hereinafter referred to as an indoor unit 40) of an air conditioner according to Embodiment 1 of the present invention. FIG. 1 shows the indoor unit 40 with a front face side thereof in the left side of the figure. Based on FIG. 1, a configuration of the indoor unit 40, particularly arrangement of a heat exchanger will be described. This indoor unit 40 supplies an air-conditioned air to an area to be air-conditioned such as indoors by using a refrigerating cycle circulating refrigerant. FIGS. 1 to 10 (Embodiment 10) each show the indoor unit with the front face side thereof in the left side in the figure. Also, in the following drawings, a relation in size among each constituent member might be different from actual one. Also, the indoor unit 40 is shown as a wall-mounting type that can be mounted on a wall face of an area to be air-conditioned as an example.

The indoor unit 40 mainly has a casing 1 in which a suction port 2 for suctioning indoor air into the inside and a blow-out port 3 for supplying an air-conditioned air to the area to be air-conditioned are formed, a fan 4 stored in this casing 1 and suctioning the indoor air from the suction port 2 and blowing out the air-conditioned air out of the blow-out port 3, and a heat exchanger 5 disposed in an air passage from the suction port 2 to the fan 4 for generating the air-conditioned air by heat exchange between refrigerant and the indoor air. An air flow passage (arrow A) is made to communicate in the casing 1 by these constituent elements.

The suction port 2 is opened and formed in an upper part of the casing 1. The blow-out port 3 is opened and formed in a lower part (more specifically, lower side on the front face portion of the casing 1) of the casing 1. The fan 4 is disposed on the downstream side of the suction port 2 and on the upstream side of the heat exchanger 5 and is configured by an axial-flow fan, a diagonal-flow fan or the like, for example. The heat exchanger 5 is disposed on a downwind side of the fan 4. For this heat exchanger 5, a fin-tube type heat exchanger or the like is preferably used. For the suction port 2, a finger guard 6 and a filter 7 are provided. Moreover, in the blow-out port 3, a mechanism for controlling a blow-out direction of an air current such as a vane, not shown, is provided. Here, the fan 4 corresponds to a blower of the present invention.

Here, a flow of air in the indoor unit 40 will be briefly explained.

First, the indoor air flows into the indoor unit 40 by the fan 4 through the suction port 2 formed in the upper part of the casing 1. At this time, dusts contained in the air are removed by the filter 7. The indoor air is heated or cooled by the refrigerant conducted through the heat exchanger 5 when passing through the heat exchanger 5 so as to become the air-conditioned air. Then, the air-conditioned air is blown out through the blow-out port 3 formed in the lower part of the casing 1 to the outside of the indoor unit 40, that is, to the area to be air-conditioned.

According to the above configuration, air having passed through the filter 7 flows into the fan 4. That is, the air flowing into the fan 4 has less disturbance in the flow than air (having passed through the heat exchanger) flowing into the indoor unit provided in an indoor unit of a prior-art air conditioner. Thus, as compared with the prior-art air conditioner, the air passing through an outer periphery portion of an impeller part of the fan 4 has fewer flow disturbances. Therefore, the air conditioner 100 according to Embodiment 1 can suppress noise, compared with the indoor unit of the prior-art air conditioner.

Also, since in the indoor unit 40, the fan 4 is provided on the upstream side of the heat exchanger 5, generation of a swirl flow or wind velocity distribution in the air blown out of the blow-out port 3 can be suppressed, compared with the indoor unit of the prior-art air conditioner in which a fan is provided at a blow-out port. Also, since there is no complicated structure such as a fan at the blow-out port 3, measures against condensation caused by a back flow or the like can be taken easily.

Embodiment 2

By constituting the heat exchanger 5 as follows, noise can be further suppressed. In Embodiment 2, a difference from Embodiment 1 will be mainly described, and the same reference numerals are given to the same portions as those in Embodiment 1. Also, a wall-mounting type indoor unit mounted on a wall face of an area to be air-conditioned is shown as an example.

Figure 2:
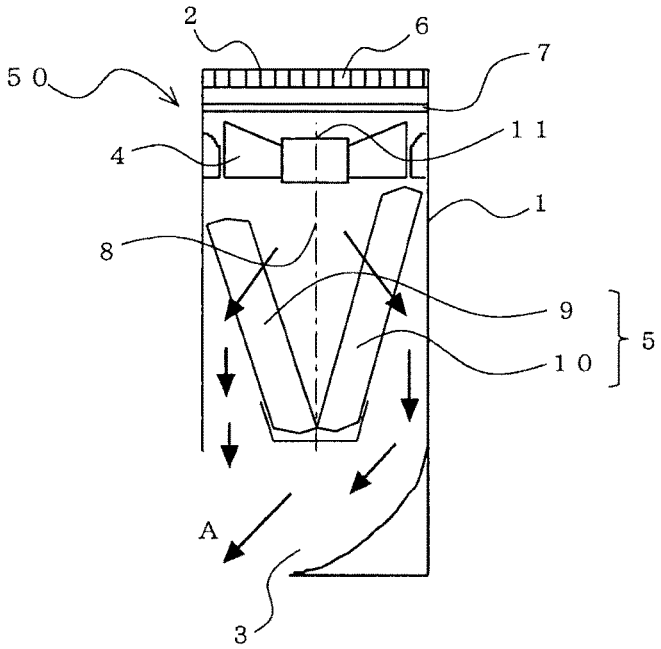
FIG. 2 is a longitudinal sectional view illustrating an example of an indoor unit of an air conditioner according to Embodiment 2.

FIG. 2 is a longitudinal sectional view illustrating an example of an indoor unit (hereinafter referred to as an indoor unit 50) of an air conditioner according to Embodiment 2 of the present invention. Based on FIG. 2, arrangement of the heat exchanger of the indoor unit 50 will be described. This indoor unit 50 supplies air-conditioned air to the area to be air-conditioned such as indoors using a refrigerating cycle for circulating the refrigerant.

As shown in FIG. 2, a front-face side heat exchanger 9 and a back-face side heat exchanger 10 constituting the heat exchanger 5 are divided by a symmetry line 8 in a longitudinal section (that is, a longitudinal section of the indoor unit 50 seen from the right side. Hereinafter, also referred to as a right-side longitudinal section) from the front face side to the back face side of the indoor unit 50. The symmetry line 8 divides an installation range of the heat exchanger 5 in this section into the horizontal direction substantially at the center part. That is, the front-face side heat exchanger 9 is arranged on the front face side (left side on the paper) against the symmetry line 8, while the back-face side heat exchanger 10 is arranged on the back face side (right side on the paper) against the symmetry line 8, respectively. The front-face side heat exchanger 9 and the back-face side heat exchanger 10 are arranged within the casing 1 so that an interval between the front-face side heat exchanger 9 and the back-face side heat exchanger 10 is getting small along the flow direction of the air, that is, a sectional shape of the heat exchanger 5 forms substantially the V-shape in the right-side longitudinal section.

That is, the front-face side heat exchanger 9 and the back-face side heat exchanger 10 are arranged so as to have an inclination to the flow direction of the air supplied from the fan 4. Moreover, an air passage area of the back-face side heat exchanger 10 is characterized by being larger than the air passage area of the front-face side heat exchanger 9. In Embodiment 2, in the right-side longitudinal section, a length of the back-face side heat exchanger 10 in the longitudinal direction is longer than a length of the front-face side heat exchanger 9 in the longitudinal direction. As a result, the air passage area of the back-face side heat exchanger 10 is larger than the air passage area of the front-face side heat exchanger 9. The other configurations of the front-face side heat exchanger 9 and the back-face side heat exchanger 10 (length in the depth direction or the like in FIG. 2) are the same. That is, a heat transfer area of the back-face side heat exchanger 10 is larger than the heat transfer area of the front-face side heat exchanger 9. Also, a rotating shaft 11 of the fan 4 is arranged above the symmetry line 8.

According to the above configuration, since the fan 4 is provided on the upstream side of the heat exchanger 5, the effect similar to Embodiment 1 can be obtained.

Also, according to the indoor unit 50 of Embodiment 2, a volume of air corresponding to the air passage area passes through each of the front-face side heat exchanger 9 and the back-face side heat exchanger 10. That is, an air volume of the back-face side heat exchanger 10 is larger than the air volume of the front-face side heat exchanger 9. Because of this air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend an air current in the vicinity of the blow-out port 3, and the pressure loss in the vicinity of the blow-out port 3 can be reduced. Therefore, the indoor unit 50 according to Embodiment 2 can suppress the noise, compared with the indoor unit 40 according to Embodiment 1. Also, since the indoor unit 50 can reduce the pressure loss in the vicinity of the blow-out port 3, power consumption can be also reduced.

Also, a volume of air corresponding to the heat transfer area passes through each of the front-face side heat exchanger 9 and the back-face side heat exchanger 10. Thus, heat exchange performance of the heat exchanger 5 is improved.

The heat exchanger 5 shown in FIG. 2 is constituted by the front-face side heat exchanger 9 and the back-face side heat exchanger 10 formed separately substantially in the V-shape, but not limited to this constitution. For example, the front-face side heat exchanger 9 and the back-face side heat exchanger 10 may be constituted by an integral heat exchanger (See FIG. 12). Also, for example, each of the front-face side heat exchanger 9 and the back-face side heat exchanger 10 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of each length in the longitudinal direction of the plurality of heat exchangers constituting the front-face side heat exchanger 9 becomes the length in the longitudinal direction of the front-face side heat exchanger 9. The sum of each length in the longitudinal direction of the plurality of heat exchangers constituting the back-face side heat exchanger 10 becomes the length in the longitudinal direction of the back-face side heat exchanger 10.

Figure 12:
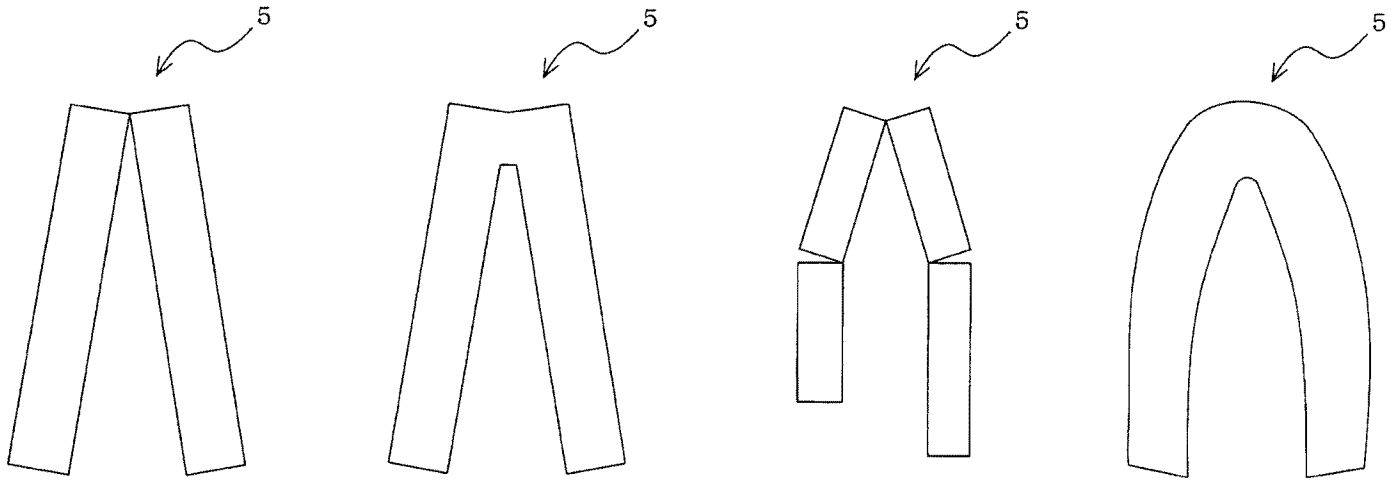
FIG. 12 is an outline diagram for explaining a configuration example of a heat exchanger 5.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers (for example, if it is constituted by the front-face side heat exchanger 9 and the back-face side heat exchanger 10), it is not necessary that each heat exchanger is in full contact at a portion where arrangement gradient of the heat exchanger 5 is changed (for example, at a substantial connection portion between the front-face side heat exchanger 9 and the back-face side heat exchanger 10) but there may be some gaps.

Also, the shape of the heat exchanger 5 in the right-side longitudinal section may be partially or entirely curved (See FIG. 12).

FIG. 12 is an outline diagram for explaining a configuration example of the heat exchanger 5. FIG. 12 shows the heat exchanger 5 seen from the right-side longitudinal section. The entire shape of the heat exchanger 5 shown in FIG. 12 is substantially the inverted V-shape, but the entire shape of the heat exchanger is only an example.

As shown in FIG. 12(*a*), the heat exchanger 5 may be constituted by a plurality of heat exchangers. As shown in FIG. 12(*b*), the heat exchanger 5 may be constituted by an integral heat exchanger. As shown in FIG. 12(*c*), the heat exchangers constituting the heat exchanger 5 may be further constituted by a plurality of heat exchangers. Alternatively, as shown in FIG. 12(*c*), a part of the heat exchangers constituting the heat exchanger 5 may be arranged perpendicularly. As shown in FIG. 12(*d*), the shape of the heat exchanger 5 may be a curved shape.

Embodiment 3

The heat exchanger 5 may be constituted as follows. In Embodiment 3, a difference from the above-mentioned Embodiment 2 will be mainly described, and the same reference numerals are given to the same portions as those in Embodiment 2. Also, a wall-mounting type indoor unit mounted on a wall face of an area to be air-conditioned is shown as an example.

Figure 3:
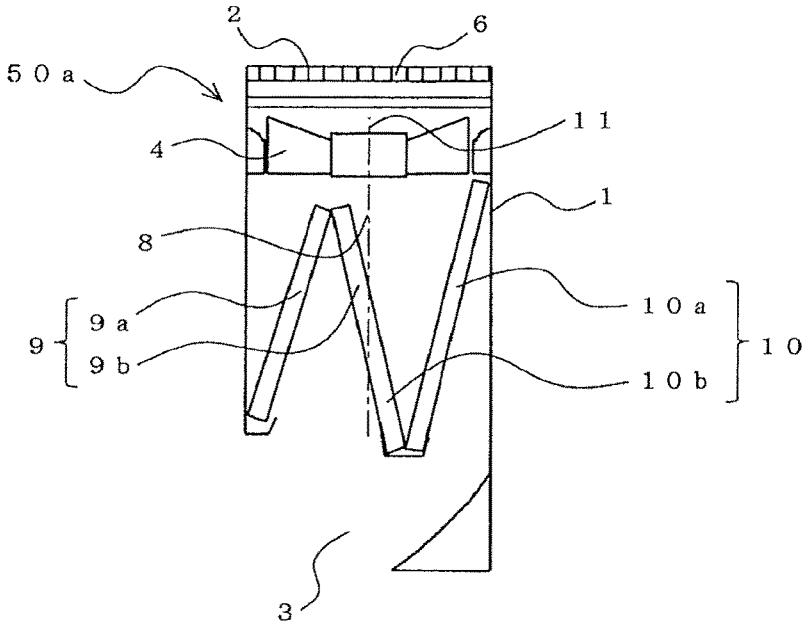
FIG. 3 is a longitudinal sectional view illustrating an example of an indoor unit of an air conditioner according to Embodiment 3.

FIG. 3 is a longitudinal sectional view illustrating an example of an indoor unit (hereinafter, referred to as an indoor unit 50*a*) of an air conditioner according to Embodiment 3 of the present invention. Based on FIG. 3, arrangement of the heat exchanger of the indoor unit 50*a* will be described. This indoor unit 50*a* supplies air-conditioned air to the area to be air-conditioned such as indoors using a refrigerating cycle for circulating the refrigerant.

In the indoor unit 50*a* of Embodiment 3, arrangement of the heat exchanger 5 is different from the indoor unit 50 of Embodiment 2.

The heat exchanger 5 is constituted by three heat exchangers, and each of these heat exchangers is arranged with different inclinations with respect to a flow direction of air supplied from the fan 4. The heat exchanger 5 forms substantially an N-shape in the right-side longitudinal section. Here, a heat exchanger 9*a* and a heat exchanger 9*b* arranged on the front face side from the symmetry line 8 constitute the front-face side heat exchanger 9, while a heat exchanger 10*a* and a heat exchanger 10*b* arranged on the back face side from the symmetry line 8 constitute the back-face side heat exchanger 10. That is, in Embodiment 3, the heat exchanger 9*b* and the heat exchanger 10*b* are constituted by integral heat exchangers. The symmetry line 8 divides the installation range of the heat exchanger 5 in the right-side longitudinal section in the right and left direction substantially at the center part.

Also, in the right-side longitudinal section, the length in the longitudinal direction of the back-face side heat exchanger 10 is longer than the length in the longitudinal direction of the front-face side heat exchanger 9. That is, an air volume of the back-face side heat exchanger 10 is larger than the air volume of the front-face side heat exchanger 9. Here, when the lengths are to be compared, the length can be compared between the sum of the lengths of the heat exchanger group constituting the front-face side heat exchanger 9 and the sum of the lengths of the heat exchanger group constituting the back-face side heat exchanger 10.

According to this configuration, the air volume of the back-face side heat exchanger 10 is larger than the air volume of the front-face side heat exchanger 9. Thus, similarly to Embodiment 2, because of this air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*a* according to Embodiment 3 can suppress noise better than the indoor unit 40 according to Embodiment 1. Also, since the indoor unit 50*a* can reduce the pressure loss in the vicinity of the blow-out port 3, power consumption can be also reduced.

Also, by making the heat exchanger 5 substantially the N-shape type in the right-side longitudinal section, the area passing through the front-face side heat exchanger 9 and the back-face side heat exchanger 10 can be made larger, and the wind velocity passing through each can be made smaller than Embodiment 2. Thus, the pressure loss in the front-face side heat exchanger 9 and the back-face side heat exchanger 10 can be reduced better than Embodiment 2, and further reduction in power consumption and noise can be realized.

The heat exchanger 5 shown in FIG. 3 is constituted by three heat exchangers formed separately substantially in the N shape, but not limited to this constitution. For example, the three heat exchangers constituting the heat exchanger 5 may be constituted by an integral heat exchanger (See FIG. 12). Also, for example, each of the three heat exchangers constituting the heat exchanger 5 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers, it is not necessary that each heat exchanger is in full contact at a portion where arrangement gradient of the heat exchanger 5 is changed, but there may be some gaps.

Also, the shape of the heat exchanger 5 in the right-side longitudinal section may be partially or entirely curved (See FIG. 12).

Embodiment 4

Also, the heat exchanger 5 may be constituted as follows. In this embodiment 4, a difference from the above-mentioned Embodiments 2 and 3 will be mainly described, and the same reference numerals are given to the same portions as those in Embodiments 2 and 3. Also, a wall-mounting type indoor unit mounted on a wall face of an area to be air-conditioned is shown as an example.

Figure 4:
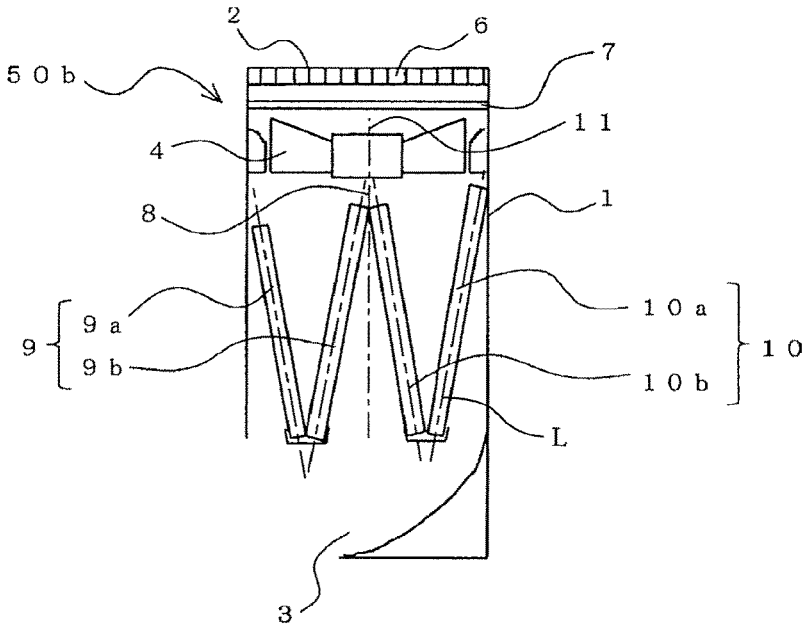
FIG. 4 is a longitudinal sectional view illustrating an example of an indoor unit of an air conditioner according to Embodiment 4.

FIG. 4 is a longitudinal sectional view illustrating an example of an indoor unit (hereinafter, referred to as an indoor unit 50*b*) of an air conditioner according to Embodiment 4 of the present invention. Based on FIG. 4, the arrangement of the heat exchanger of the indoor unit 50*b* will be described. This indoor unit 50*b* supplies air-conditioned air to the area to be air-conditioned such as indoors using a refrigerating cycle for circulating refrigerant.

In the indoor unit 50*b* of Embodiment 4 is different from the indoor units shown in Embodiment 2 and Embodiment 3 in the arrangement of the heat exchanger 5.

The heat exchanger 5 is constituted by four heat exchangers, and each of the heat exchangers is arranged with different inclinations with respect to the flow direction of the air supplied from the fan 4. The heat exchanger 5 forms substantially a W-shape in the right-side longitudinal section. That is, as can be seen in FIG. 4, each of the heat exchangers in right-side longitudinal section takes the form of an elongated quadrilateral. Lines "L" extending along the direction of elongation of each of the respective quadrilaterals, and at the centers of the respective quadrilaterals, together form substantially a W-shape. Here, the heat exchanger 9*a* and the heat exchanger 9*b* arranged on the front face side from the symmetry line 8 constitute the front-face side heat exchanger 9, while the heat exchanger 10*a* and the heat exchanger 10*b* arranged on the back face side from the symmetry line 8 constitute the back-face side heat exchanger 10. The symmetry line 8 divides the installation range of the heat exchanger 5 in the right-side longitudinal section in the right and left direction substantially at the center part.

Also, in the right-side longitudinal section, the length in the longitudinal direction of the back-face side heat exchanger 10 is longer than the length in the longitudinal direction of the front-face side heat exchanger 9. That is, an air volume of the back-face side heat exchanger 10 is larger than the air volume of the front-face side heat exchanger 9. Here, when the lengths are to be compared, the length can be compared between the sum of the lengths of the heat exchanger group constituting the front-face side heat exchanger 9 and the sum of the lengths of the heat exchanger group constituting the back-face side heat exchanger 10.

According to this configuration, the air volume of the back-face side heat exchanger 10 is larger than the air volume of the front-face side heat exchanger 9. Thus, similarly to Embodiments 2 and 3, because of this air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*b* according to Embodiment 4 can suppress noise better than the indoor unit 40 according to Embodiment 1. Also, since the indoor unit 50*b* can reduce the pressure loss in the vicinity of the blow-out port 3, power consumption can be also reduced.

Also, by making the heat exchanger 5 substantially the W-shape type in the right-side longitudinal section, the area passing through the front-face side heat exchanger 9 and the back-face side heat exchanger 10 can be made larger, and the wind velocity passing through each can be made smaller than Embodiments 2 and 3. Thus, the pressure loss in the front-face side heat exchanger 9 and the back-face side heat exchanger 10 can be reduced better than Embodiments 2 and 3, and further reduction in power consumption and noise can be realized.

The heat exchanger 5 shown in FIG. 4 is constituted by four heat exchangers formed separately substantially in the W shape, but not limited to this constitution. For example, the four heat exchangers constituting the heat exchanger 5 may be constituted by an integral heat exchanger (See FIG. 12). Also, for example, each of the four heat exchangers constituting the heat exchanger 5 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers, it is not necessary that each heat exchanger is in full contact at a portion where arrangement gradient of the heat exchanger 5 is changed, but there may be some gap.

Also, the shape of the heat exchanger 5 in the right-side longitudinal section may be partially or entirely curved (See FIG. 12).

Embodiment 5

Also, the heat exchanger 5 may be constituted as follows. In this embodiment 5, a difference from the above-mentioned Embodiments 2 to 4 will be mainly described, and the same reference numerals are given to the same portions as those in Embodiments 2 to 4. Also, a wall-mounting type indoor unit mounted on a wall face of an area to be air-conditioned is shown as an example.

Figure 5:
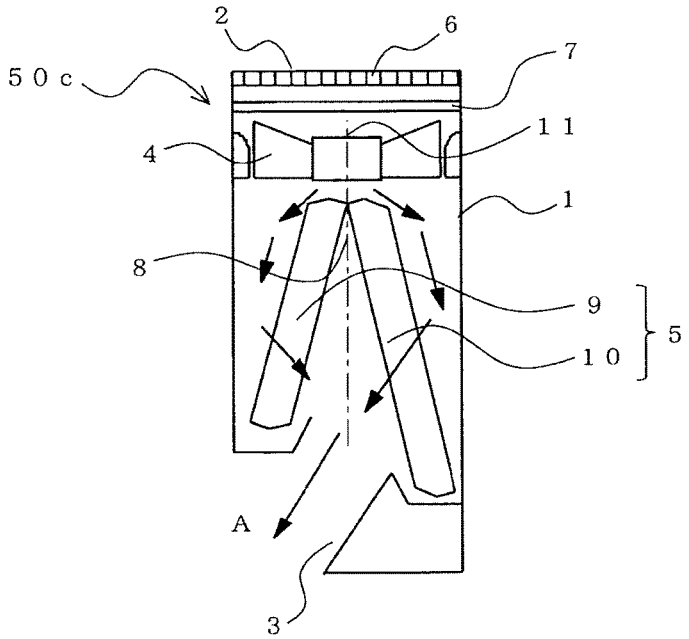
FIG. 5 is a longitudinal sectional view illustrating an example of an indoor unit of an air conditioner according to Embodiment 5.

FIG. 5 is a longitudinal sectional view illustrating an example of an indoor unit (hereinafter, referred to as an indoor unit 50*c*) of an air conditioner according to Embodiment 5 of the present invention. Based on FIG. 5, the arrangement of the heat exchanger of the indoor unit 50*c* will be described. This indoor unit 50*c* supplies air-conditioned air to the area to be air-conditioned such as indoors using a refrigerating cycle for circulating refrigerant.

The indoor unit 50*c* of Embodiment 5 is different from the indoor units shown in Embodiments 2 to 4 in the arrangement of the heat exchanger 5.

More specifically, the indoor unit 50*c* of Embodiment 5 is constituted by two heat exchangers (front-face side heat exchanger 9 and the back-face side heat exchanger 10) as in Embodiment 2. However, the arrangement of the front-face side heat exchanger 9 and the back-face side heat exchanger 10 is different from the indoor unit 50 shown in Embodiment 2.

That is, the front-face side heat exchanger 9 and the back-face side heat exchanger 10 are arranged with different inclinations with respect to the flow direction of the air supplied from the fan 4. Also, the front-face side heat exchanger 9 is arranged on the front face side from the symmetry line 8, while the back-face side heat exchanger 10 is arranged on the back face side from the symmetry line 8. The heat exchanger 5 forms substantially an inverted V-shape in the right-side longitudinal section.

The symmetry line 8 divides the installation range of the heat exchanger 5 in the right-side longitudinal section in the right and left direction substantially at the center part.

Also, in the right-side longitudinal section, the length in the longitudinal direction of the back-face side heat exchanger 10 is longer than the length in the longitudinal direction of the front-face side heat exchanger 9. That is, an air volume of the back-face side heat exchanger 10 is larger than the air volume of the front-face side heat exchanger 9. Here, when the lengths are to be compared, the length can be compared between the sum of the lengths of the heat exchanger group constituting the front-face side heat exchanger 9 and the sum of the lengths of the heat exchanger group constituting the back-face side heat exchanger 10.

In the indoor unit 50*c* constituted as above, an air flow inside is as follows.

First, the indoor air flows into the indoor unit 50*c* by the fan 4 from the suction port 2 formed in the upper part of the casing 1. At this time, dusts contained in the air are removed by the filter 7. The indoor air is heated or cooled by the refrigerant conducting through the heat exchanger 5 when passing through the heat exchanger 5 (the front-face side heat exchanger 9 and the back-face side heat exchanger 10) so as to become the conditioned air. At this time, the air passing through the front-face side heat exchanger 9 flows from the front face side to the back face side of the indoor unit 50*c*. Also, the air passing through the back-face side heat exchanger 10 flows from the back face side to the front face side of the indoor unit 50*c*.

The conditioned air having passed through the heat exchanger 5 (the front-face side heat exchanger 9 and the back-face side heat exchanger 10) is blown out from the blow-out port 3 formed at the lower part of the casing 1 to the outside of the indoor unit 50*c*, that is, to the area to be air-conditioned.

According to the configuration as above, an air volume of the back-face side heat exchanger 10 is larger than the air volume of the front-face side heat exchanger 9. Thus, similarly to Embodiments 2 to 4, because of this air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*c* according to Embodiment 5 can suppress noise better than the indoor unit 40 according to Embodiment 1. Also, since the indoor unit 50*c* can reduce the pressure loss in the vicinity of the blow-out port 3, power consumption can be also reduced.

Also, in the indoor unit 50*c* of Embodiment 5, the flow direction of the air flowing out of the back-face side heat exchanger 10 is from the back face side to the front face side. Thus, in the indoor unit 50*c* of Embodiment 5, the flow of the air having passed through the heat exchanger 5 can be bent more easily. That is, in the indoor unit 50*c* of Embodiment 5, air-current control of the air blown out of the blow-out port 3 is easier than the indoor unit 50 according to Embodiment 2. Therefore, in the indoor unit 50 according to Embodiment 5, it is no longer necessary to rapidly bend the air current in the vicinity of the blow-out port 3 as compared with the indoor unit 50 according to Embodiment 2, and further reduction in power consumption and noise can be realized.

The heat exchanger 5 shown in FIG. 5 is constituted by the front-face side heat exchanger 9 and the back-face side heat exchanger 10 formed separately substantially in the inverted V shape, but not limited to this constitution. For example, the front-face side heat exchanger 9 and the back-face side heat exchanger 10 may be constituted by an integral heat exchanger (See FIG. 12). Also, for example, each of the front-face side heat exchanger 9 and the back-face side heat exchanger 10 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers, it is not necessary that each heat exchanger is in full contact at a portion where arrangement gradient of the heat exchanger 5 is changed, but there may be some gaps.

Also, the shape of the heat exchanger 5 in the right-side longitudinal section may be partially or entirely curved (See FIG. 12).

Embodiment 6

Also, the heat exchanger 5 may be constituted as follows. In this embodiment 6, a difference from the above-mentioned Embodiments 2 to 5 will be mainly described, and the same reference numerals are given to the same portions as those in Embodiments 2 to 5. Also, a wall-mounting type indoor unit mounted on a wall face of an area to be air-conditioned is shown as an example.

Figure 6:
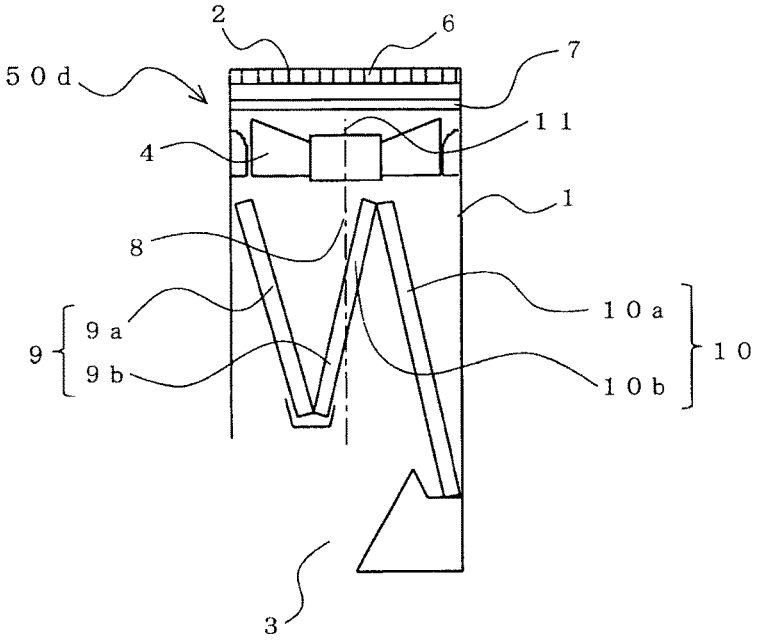
FIG. 6 is a longitudinal sectional view illustrating an example of an indoor unit of an air conditioner according to Embodiment 6.

FIG. 6 is a longitudinal sectional view illustrating an example of an indoor unit (hereinafter, referred to as an indoor unit 50*d*) of an air conditioner according to Embodiment 6 of the present invention. Based on FIG. 6, the arrangement of the heat exchanger of the indoor unit 50*d* will be described. This indoor unit 50*d* supplies air-conditioned air to the area to be air-conditioned such as indoors using a refrigerating cycle for circulating refrigerant.

The indoor unit 50*d* of Embodiment 6 is different from the indoor units shown in Embodiments 2 to 5 in the arrangement of the heat exchanger 5.

More specifically, the indoor unit 50*d* of Embodiment 6 is constituted by three heat exchangers as in Embodiment 3. However, the arrangement of these three heat exchangers is different from the indoor unit 50*a* shown in Embodiment 3.

That is, each of the three heat exchangers constituting the heat exchanger 5 is arranged with different inclinations with respect to a flow direction of air supplied from the fan 4. The heat exchanger 5 forms substantially the inverted N-shape in the right-side longitudinal section. Here, the heat exchanger 9*a* and the heat exchanger 9*b* arranged on the front face side from the symmetry line 8 constitute the front-face side heat exchanger 9, while the heat exchanger 10*a* and the heat exchanger 10*b* arranged on the back face side from the symmetry line 8 constitute the back-face side heat exchanger 10. That is, in Embodiment 6, the heat exchanger 9*b* and the heat exchanger 10*b* are constituted by integral heat exchangers. The symmetry line 8 divides the installation range of the heat exchanger 5 in the right-side longitudinal section in the right and left direction substantially at the center part.

Also, in the right-side longitudinal section, the length in the longitudinal direction of the back-face side heat exchanger 10 is longer than the length in the longitudinal direction of the front-face side heat exchanger 9. That is, an air volume of the back-face side heat exchanger 10 is larger than the air volume of the front-face side heat exchanger 9. Here, when the lengths are to be compared, the length can be compared between the sum of the lengths of the heat exchanger group constituting the front-face side heat exchanger 9 and the sum of the lengths of the heat exchanger group constituting the back-face side heat exchanger 10.

According to this configuration, the air volume of the back-face side heat exchanger 10 is larger than the air volume of the front-face side heat exchanger 9. Thus, similarly to Embodiments 2 to 5, because of the air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*d* according to Embodiment 6 can suppress noise better than the indoor unit 40 according to Embodiment 1. Also, since the indoor unit 50*d* can reduce the pressure loss in the vicinity of the blow-out port 3, power consumption can be also reduced.

Also, in the indoor unit 50*d* of Embodiment 6, the flow direction of the air flowing out of the back-face side heat exchanger 10 is from the back face side to the front face side. Thus, in the indoor unit 50*d* of Embodiment 6, the flow of the air having passed through the heat exchanger 5 can be bent more easily. That is, in the indoor unit 50*d* of Embodiment 6, air-current control of the air blown out of the blow-out port 3 is easier than the indoor unit 50*a* according to Embodiment 3. Therefore, in the indoor unit 50*d* according to Embodiment 6, it is no longer necessary to rapidly bend the air current in the vicinity of the blow-out port 3 as compared with the indoor unit 50*a* according to Embodiment 3, and further reduction in power consumption and noise can be realized.

Also, by making the heat exchanger 5 substantially the inverted N-shape type in the right-side longitudinal section, the area passing through the front-face side heat exchanger 9 and the back-face side heat exchanger 10 can be made larger, and the wind velocity passing through each can be made smaller than Embodiment 5. Thus, the pressure loss in the front-face side heat exchanger 9 and the back-face side heat exchanger 10 can be reduced better than Embodiment 5, and further reduction in power consumption and noise can be realized.

The heat exchanger 5 shown in FIG. 6 is constituted by the three heat exchangers formed separately substantially in the inverted N shape, but not limited to this constitution. For example, the three heat exchangers constituting the heat exchanger 5 may be constituted by an integral heat exchanger (See FIG. 12). Also, for example, each of the three heat exchangers constituting the heat exchanger 5 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers, it is not necessary that each heat exchanger is in full contact at a portion where arrangement gradient of the heat exchanger 5 is changed, but there may be some gaps.

Also, the shape of the heat exchanger 5 in the right-side longitudinal section may be partially or entirely curved (See FIG. 12).

Embodiment 7

Also, the heat exchanger 5 may be constituted as follows. In this embodiment 7, a difference from the above-mentioned Embodiments 2 to 6 will be mainly described, and the same reference numerals are given to the same portions as those in Embodiments 2 to 6. Also, a wall-mounting type indoor unit mounted on a wall face of an area to be air-conditioned is shown as an example.

Figure 7:
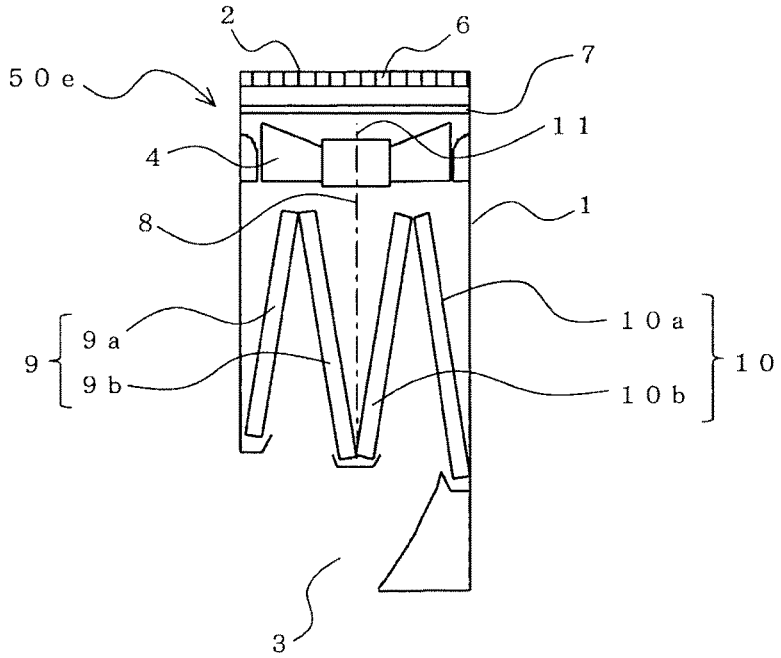
FIG. 7 is a longitudinal sectional view illustrating an example of an indoor unit of an air conditioner according to Embodiment 7.

FIG. 7 is a longitudinal sectional view illustrating an example of an indoor unit (hereinafter, referred to as an indoor unit 50*e*) of an air conditioner according to Embodiment 7 of the present invention. Based on FIG. 7, the arrangement of the heat exchanger of the indoor unit 50*e* will be described. This indoor unit 50*e* supplies air-conditioned air to the area to be air-conditioned such as indoors using a refrigerating cycle for circulating refrigerant.

The indoor unit 50*e* of Embodiment 7 is different from the indoor units shown in Embodiments 2 to 6 in the arrangement of the heat exchanger 5.

More specifically, the indoor unit 50*e* of Embodiment 7 is constituted by four heat exchangers as in Embodiment 4. However, arrangement of these four heat exchangers is different from the indoor unit 50*b* shown in Embodiment 4.

That is, each of the four heat exchangers constituting the heat exchanger 5 is arranged with different inclinations with respect to a flow direction of air supplied from the fan 4. The heat exchanger 5 forms substantially an M-shape in the right-side longitudinal section. Here, the heat exchanger 9*a* and the heat exchanger 9*b* arranged on the front face side from the symmetry line 8 constitute the front-face side heat exchanger 9, while the heat exchanger 10*a* and the heat exchanger 10*b* arranged on the back face side from the symmetry line 8 constitute the back-face side heat exchanger 10. The symmetry line 8 divides the installation range of the heat exchanger 5 in the right-side longitudinal section in the right and left direction substantially at the center part.

Also, in the right-side longitudinal section, the length in the longitudinal direction of the back-face side heat exchanger 10 is longer than the length in the longitudinal direction of the front-face side heat exchanger 9. That is, an air volume of the back-face side heat exchanger 10 is larger than the air volume of the front-face side heat exchanger 9. Here, when the lengths are to be compared, the length can be compared between the sum of the lengths of the heat exchanger group constituting the front-face side heat exchanger 9 and the sum of the lengths of the heat exchanger group constituting the back-face side heat exchanger 10.

According to this configuration, the air volume of the back-face side heat exchanger 10 is larger than the air volume of the front-face side heat exchanger 9. Thus, similarly to Embodiments 2 to 6, because of the air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*e* according to Embodiment 7 can suppress noise better than the indoor unit 40 according to Embodiment 1. Also, since the indoor unit 50*e* can reduce the pressure loss in the vicinity of the blow-out port 3, power consumption can be also reduced.

Also, in the indoor unit 50*e* of Embodiment 7, the flow direction of the air flowing out of the back-face side heat exchanger 10 is from the back face side to the front face side. Thus, in the indoor unit 50*e* of Embodiment 7, the flow of the air having passed through the heat exchanger 5 can be bent more easily. That is, in the indoor unit 50*e* of Embodiment 7, air-current control of the air blown out of the blow-out port 3 is easier than the indoor unit 50*b* according to Embodiment 4. Therefore, in the indoor unit 50*e* according to Embodiment 7, it is no longer necessary to rapidly bend the air current in the vicinity of the blow-out port 3 as compared with the indoor unit 50*b* according to Embodiment 4, and further reduction in power consumption and noise can be realized.

Also, by making the shape of the heat exchanger 5 substantially the M-shape type in the right-side longitudinal section, the area passing through the front-face side heat exchanger 9 and the back-face side heat exchanger 10 can be made larger, and the wind velocity passing through each can be made smaller than Embodiments 5 and 6. Thus, the pressure loss in the front-face side heat exchanger 9 and the back-face side heat exchanger 10 can be reduced better than Embodiments 2 and 6, and further reduction in power consumption and noise can be realized.

The heat exchanger 5 shown in FIG. 7 is constituted by the four heat exchangers formed separately substantially in the M shape, but not limited to this constitution. For example, the four heat exchangers constituting the heat exchanger may be constituted by an integral heat exchanger (See FIG. 12). Also, for example, each of the four heat exchangers constituting the heat exchanger 5 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers, it is not necessary that each heat exchanger is in full contact at a portion where arrangement gradient of the heat exchanger 5 is changed, but there may be some gap.

Also, the shape of the heat exchanger 5 in the right-side longitudinal section may be partially or entirely curved (See FIG. 12).

Embodiment 8

Also, the heat exchanger 5 may be constituted as follows. In this embodiment 8, a difference from the above-mentioned Embodiments 2 to 7 will be mainly described, and the same reference numerals are given to the same portions as those in Embodiments 2 to 7. Also, a wall-mounting type indoor unit mounted on a wall face of an area to be air-conditioned is shown as an example.

Figure 8:
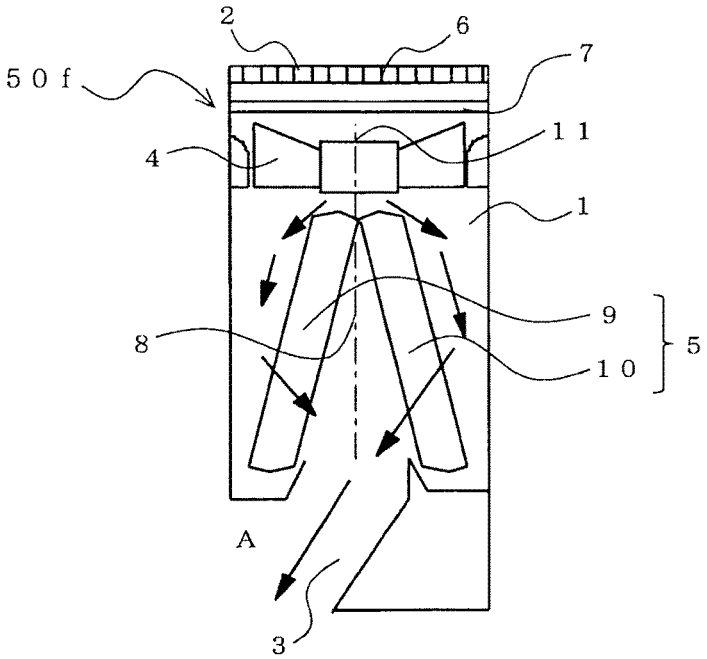
FIG. 8 is a longitudinal sectional view illustrating an example of an indoor unit of an air conditioner according to Embodiment 8.

FIG. 8 is a longitudinal sectional view illustrating an example of an indoor unit (hereinafter, referred to as an indoor unit 50*f*) of an air conditioner according to Embodiment 7 of the present invention. Based on FIG. 8, the arrangement of the heat exchanger of the indoor unit 50*f* will be described. This indoor unit 50*f* supplies air-conditioned air to the area to be air-conditioned such as indoors using a refrigerating cycle for circulating refrigerant.

The indoor unit 50*f* of Embodiment 8 is different from the indoor units shown in Embodiments 2 to 7 in the arrangement of the heat exchanger 5.

More specifically, the indoor unit 50*f* of Embodiment 8 is constituted by two heat exchangers (front-face side heat exchanger 9 and the back-face side heat exchanger 10) as in Embodiment 5 and forms substantially an inverted V shape in the right-side longitudinal section. However, in Embodiment 8, by making pressure losses of the front-face side heat exchanger 9 and the back-face side heat exchanger 10 different from each other, air volumes of the front-face side heat exchanger 9 and the back-face side heat exchanger 10 are made different.

That is, the front-face side heat exchanger 9 and the back-face side heat exchanger 10 are arranged with different inclination with respect to the flow direction of the air supplied from the fan 4. The front-face side heat exchanger 9 is arranged on the front face side from the symmetry line 8, while the back-face side heat exchanger 10 is arranged on the back face side from the symmetry line 8. The heat exchanger 5 forms substantially an inverted V-shape in the right-side longitudinal section.

In the right-side longitudinal section, the length in the longitudinal direction of the back-face side heat exchanger 10 is the same as the length in the longitudinal direction of the front-face side heat exchanger 9. Specifications of the front-face side heat exchanger 9 and the back-face side heat exchanger 10 are determined so that the pressure loss of the back-face side heat exchanger 10 is smaller than the pressure loss of the front-face side heat exchanger 9. If a fin-tube type heat exchanger is used as the front-face side heat exchanger 9 and the back-face side heat exchanger 10, for example, it is only necessary that a length in the lateral direction (fin width) of the back-face side heat exchanger 10 in the right-side longitudinal section is made smaller than a length in the lateral direction (fin width) of the front-face side heat exchanger 9 in the right-side longitudinal section. Also, for example, it is only necessary that an inter-fin distance of the right back-face side heat exchanger 10 is made larger than the inter-fin distance of the front-face side heat exchanger 9. Also, for example, it is only necessary that a pipe diameter of the right back-face side heat exchanger 10 is made smaller than the pipe diameter of the front-face side heat exchanger 9. Also, for example, it is only necessary that the number of the pipes in the right back-face side heat exchanger 10 is made smaller than the number of pipes in the front-face side heat exchanger 9.

The symmetry line 8 divides the installation range of the heat exchanger 5 in the right-side longitudinal section in the right and left direction substantially at the center part.

According to the configuration as above, since the fan 4 is provided on the upstream side of the heat exchanger 5, the effect similar to Embodiment 1 can be obtained.

Also, according to the indoor unit 50*f* according to Embodiment 8, a volume of air corresponding to the pressure loss passes through each of the front-face side heat exchanger 9 and the back-face side heat exchanger 10. That is, the air volume of the back-face side heat exchanger 10 is larger than the air volume of the front-face side heat exchanger 9. Then, because of the air-volume difference, when the air having passed through each of the front-face side heat exchanger 9 and the back-face side heat exchanger 10 is merged together, the merged air is bent to the front face side (blow-out port 3 side). Thus, it is no longer necessary to rapidly bend the air current in the vicinity of the blow-out port 3, and the pressure loss in the vicinity of the blow-out port 3 can be reduced. Therefore, the indoor unit 50*f* according to Embodiment 8 can suppress noise better than the indoor unit 40 according to Embodiment 1 without increasing the length of the back-face side heat exchanger 10 in the right-side longitudinal section. Also, since the indoor unit 50*f* can reduce the pressure loss in the vicinity of the blow-out port 3, power consumption can be also reduced.

The heat exchanger 5 shown in FIG. 8 is constituted by the front-face side heat exchanger 9 and the back-face side heat exchanger 10 formed separately substantially in the inverted V shape, but not limited to this constitution. For example, the shape of the heat exchanger 5 in the right-side longitudinal section may be constituted substantially in the V shape, substantially in the N shape, substantially in the W shape, substantially in the inverted N type or substantially in the M type and the like. Also, for example, the front-face side heat exchanger 9 and the back-face side heat exchanger 10 may be constituted by an integral heat exchanger (See FIG. 12). Also, for example, each of the front-face side heat exchanger 9 and the back-face side heat exchanger 10 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers (if constituted by the front-face side heat exchanger 9 and the back-face side heat exchanger 10, for example), it is not necessary that each heat exchanger is in full contact at a portion (substantial connection portion between the front-face side heat exchanger 9 and the back-face side heat exchanger 10, for example) where arrangement gradient of the heat exchanger 5 is changed, but there may be some gaps.

Also, the shape of the heat exchanger 5 in the right-side longitudinal section may be partially or entirely curved (See FIG. 12).

Embodiment 9

Also, in the above-mentioned Embodiments 2 to 8, the fan 4 may be arranged as follows. In this Embodiment 9, a difference from the above-mentioned Embodiments 2 to 8 will be mainly described, and the same reference numerals are given to the same portions as those in Embodiments 2 to 8. Also, a wall-mounting type indoor unit mounted on a wall face of an area to be air-conditioned is shown as an example.

Figure 9:
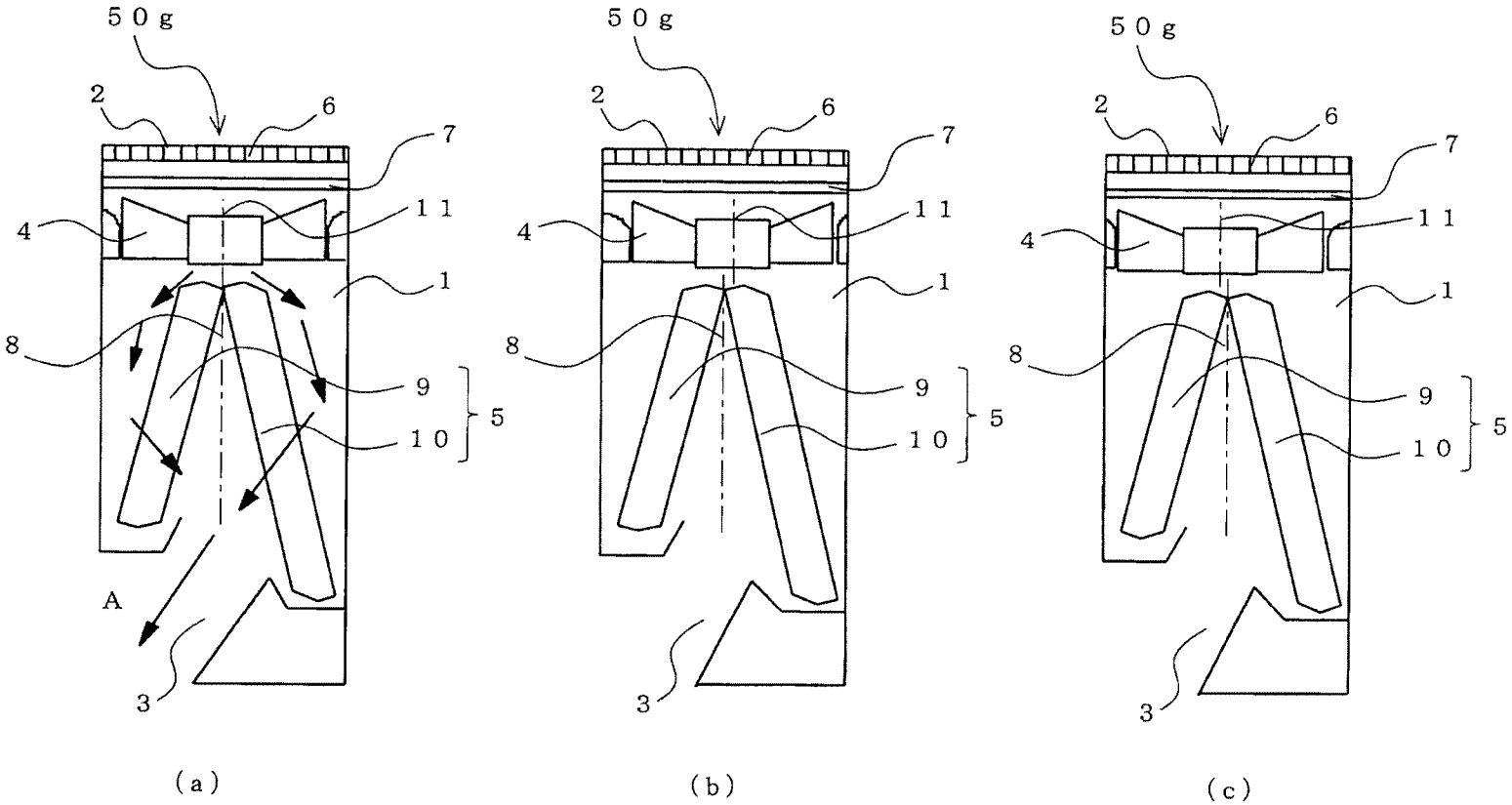
FIG. 9 is a longitudinal sectional view illustrating an example of an indoor unit of an air conditioner according to Embodiment 9.

FIG. 9 is a longitudinal sectional view illustrating an example of an indoor unit (hereinafter, referred to as an indoor unit 50*g*) of an air conditioner according to Embodiment 9 of the present invention. Based on FIGS. 9(*a*) to 9(*c*), arrangement of the fan 4 in the indoor unit 50*g* will be described. This indoor unit 50*g* supplies air-conditioned air to the area to be air-conditioned such as indoors using a refrigerating cycle for circulating the refrigerant.

The heat exchanger 5 of the indoor unit 50*g* according to Embodiment 9 is arranged similarly to the indoor unit 50*c* of Embodiment 5. However, the indoor unit 50*g* according to Embodiment 9 is different from the indoor unit 50*c* of Embodiment 5 in arrangement of the fan 4.

That is, in the indoor unit 50*g* according to Embodiment 9, the arrangement position of the fan 4 is determined according to the air volume and a heat transfer area of the front-face side heat exchanger 9 and the back-face side heat exchanger 10.

For example, in a state shown in FIG. 8(*a*) (a state in which the rotating shaft 11 of the fan 4 and the position of the symmetry line 8 substantially match each other in the right-side longitudinal direction), the air volume of the back-face side heat exchanger 10 with a heat transfer area larger than that of the front-face side heat exchanger 9 might run short. If the air volume of the back-face side heat exchanger 10 runs short, the heat exchanger 5 (the front-face side heat exchanger 9 and the back-face side heat exchanger 10) might not be able to exert desired heat exchange performances. In such a case, as shown in FIG. 8(*b*), it is advisable to move the arrangement position of the fan 4 to the back-face direction.

By constituting as above, the air-volume distribution according to the heat transfer areas of the front-face side heat exchanger 9 and the back-face side heat exchanger 10 is realized, and the heat exchange performances of the heat exchanger 5 (the front-face side heat exchanger 9 and the back-face side heat exchanger 10) is improved.

Also, for example, in a state shown in FIG. 8(*a*), the air volume of the back-face side heat exchanger 10 might run short such as a case in which the pressure loss of the back-face side heat exchanger 10 is large. Also, due to restriction on a space in the casing 1, only with the air-volume adjustment in the configuration of the front-face side heat exchanger 9 and the back-face side heat exchanger 10, the air merged after having passed through each of the front-face side heat exchanger 9 and the back-face side heat exchanger 10 might not be able to be adjusted to a desired angle. If the air volume of the back-face side heat exchanger 10 runs short as above, the air merged after having passed through each of the front-face side heat exchanger 9 and the back-face side heat exchanger 10 might not be bent more than a desired angle. In such a case, as shown in FIG. 8(*b*), it is advisable that the arrangement position of the fan 4 is moved to the back-face direction.

By constituting as above, fine adjustment of the air volume of each of the front-face side heat exchanger 9 and the back-face side heat exchanger 10 becomes possible, and the air merged after having passed through each of the front-face side heat exchanger 9 and the back-face side heat exchanger 10 can be bent at a desired angle. Thus, on the basis of a formation position of the blow-out port 3, the flow direction of the air merged after having passed through each of the front-face side heat exchanger 9 and the back-face side heat exchanger 10 can be adjusted to a suitable direction.

Also, for example, the heat transfer area of the front-face side heat exchanger 9 might be larger than the heat transfer area of the back-face side heat exchanger 10. In such a case, as shown in FIG. 8(*c*), it is advisable that the arrangement position of the fan 4 is moved to the front-face direction.

By constituting as above, air-volume distribution corresponding to the heat transfer areas of the front-face side heat exchanger 9 and the back-face side heat exchanger 10 is made possible, and heat exchange performances of the heat exchanger 5 (the front-face side heat exchanger 9 and the back-face side heat exchanger 10) is improved.

Also, for example, in a state shown in FIG. 8(*a*), the air volume of the front-face side heat exchanger 9 might become larger than necessary. Also, due to restriction on a space in the casing 1, only with the air-volume adjustment in the configuration of the front-face side heat exchanger 9 and the back-face side heat exchanger 10, the air merged after having passed through each of the front-face side heat exchanger 9 and the back-face side heat exchanger 10 might not be able to be adjusted to a desired angle. Thus, the air merged after having passed through each of the front-face side heat exchanger 9 and the back-face side heat exchanger 10 might be bent for more than a desired angle. In such a case, as shown in FIG. 8(*c*), it is advisable that the arrangement position of the fan 4 is moved to the front-face direction.

By constituting as above, fine adjustment of the air volume of each of the front-face side heat exchanger 9 and the back-face side heat exchanger 10 becomes possible, and the air merged after having passed through each of the front-face side heat exchanger 9 and the back-face side heat exchanger 10 can be bent at a desired angle. Thus, the flow direction of the air merged after having passed through each of the front-face side heat exchanger 9 and the back-face side heat exchanger 10 can be adjusted to a suitable direction in accordance with a formation position of the blow-out port 3.

The heat exchanger 5 shown in FIG. 9 is constituted by the front-face side heat exchanger 9 and the back-face side heat exchanger 10 formed separately substantially in the inverted V shape, but not limited to this constitution. For example, the shape of the heat exchanger 5 in the right-side longitudinal section may be constituted substantially in the V shape, substantially in the N shape, substantially in the W type, substantially in the inverted N type or substantially in the M type and the like. Also, for example, the front-face side heat exchanger 9 and the back-face side heat exchanger 10 may be constituted by an integral heat exchanger (See FIG. 12). Also, for example, each of the front-face side heat exchanger 9 and the back-face side heat exchanger 10 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers (if constituted by the front-face side heat exchanger 9 and the back-face side heat exchanger 10, for example), it is not necessary that each heat exchanger is in full contact at a portion (substantial connection portion between the front-face side heat exchanger 9 and the back-face side heat exchanger 10, for example) where arrangement gradient of the heat exchanger 5 is changed, but there may be some gaps.

Also, the shape of the heat exchanger 5 in the right-side longitudinal section may be partially or entirely curved (See FIG. 12).

Embodiment 10

Also, in the above-mentioned Embodiments 2 to 8, the fan 4 may be arranged as follows. In Embodiment 10, a difference from the above-mentioned Embodiments 2 to 9 will be mainly described, and the same reference numerals are given to the same portions as those in Embodiments 2 to 9. Also, a wall-mounting type indoor unit mounted on a wall face of an area to be air-conditioned is shown as an example.

Figure 10:
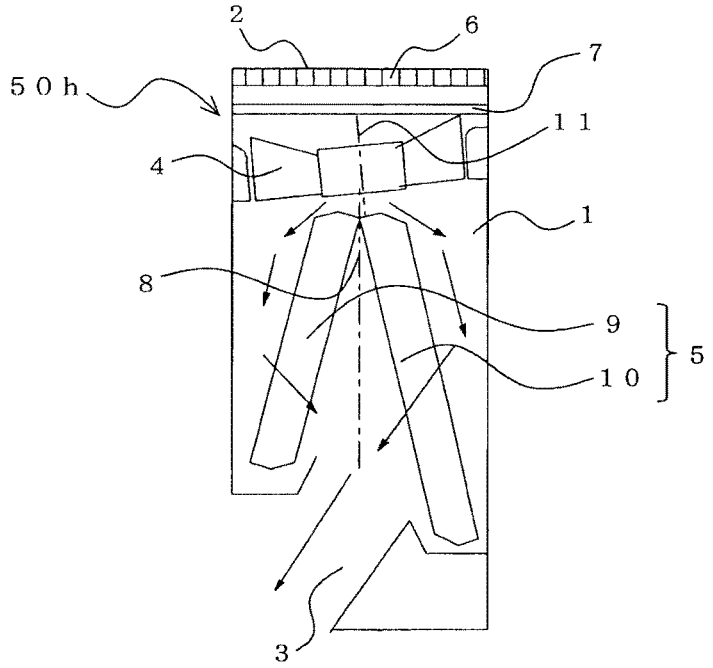
FIG. 10 is a longitudinal sectional view illustrating an example of an indoor unit of an air conditioner according to Embodiment 10.

FIG. 10 is a longitudinal sectional view illustrating an example of an indoor unit (hereinafter, referred to as an indoor unit 50*h*) of an air conditioner according to Embodiment 10 of the present invention. Based on FIG. 9, arrangement of the fan 4 in the indoor unit 50*h* will be described. This indoor unit 50*h* supplies air-conditioned air to the area to be air-conditioned such as indoors using a refrigerating cycle for circulating the refrigerant.

The heat exchanger 5 of the indoor unit 50*h* according to Embodiment 10 is arranged similarly to the indoor unit 50*c* of Embodiment 5. However, the indoor unit 50*g* according to Embodiment 9 is different from the indoor unit 50*c* of Embodiment 5 in arrangement of the fan 4.

That is, in the indoor unit 50*h* according to Embodiment 10, the inclination of the fan 4 is determined according to the air volume and a heat transfer area of the front-face side heat exchanger 9 and the back-face side heat exchanger 10.

For example, the air volume of the back-face side heat exchanger 10 with a heat transfer area larger than that of the front-face side heat exchanger 9 might run short. Also, due to restriction on a space in the casing 1, air-volume adjustment might not be able to be performed by moving the fan 4 in the front and rear direction. If the air volume of the back-face side heat exchanger 10 runs short as above, the heat exchanger 5 (the front-face side heat exchanger 9 and the back-face side heat exchanger 10) might not be able to exert desired heat exchange performances. In such a case, as shown in FIG. 10, it is advisable to incline the fan 4 in the right-side longitudinal section to the back-face side heat exchanger 10 side.

By constituting as above, even if the fan 4 cannot be moved in the front and rear direction, the air-volume distribution in accordance with the heat transfer areas of the front-face side heat exchanger 9 and the back-face side heat exchanger 10 is realized, and the heat exchange performances of the heat exchanger 5 (the front-face side heat exchanger 9 and the back-face side heat exchanger 10) is improved.

Also, for example, the air volume of the back-face side heat exchanger 10 might run short such as a case in which the pressure loss of the back-face side heat exchanger 10 is larger. Also, due to restriction on a space in the casing 1, only with the air-volume adjustment in the configuration of the front-face side heat exchanger 9 and the back-face side heat exchanger 10, the air merged after having passed through each of the front-face side heat exchanger 9 and the back-face side heat exchanger 10 might not be able to be adjusted to a desired angle. Moreover, due to restriction on a space in the casing 1, air-volume adjustment might not be able to be performed by moving the fan 4 in the front and rear direction. If the air volume of the back-face side heat exchanger 10 runs short as above, the air merged after having passed through each of the front-face side heat exchanger 9 and the back-face side heat exchanger 10 might not be bent more than a desired angle. In such a case, as shown in FIG. 10, it is advisable that the fan 4 is inclined to the back-face side heat exchanger 10 side in the right-side longitudinal section.

By constituting as above, even if the fan 4 cannot be moved in the front and rear direction, fine control of the air volume of each of the front-face side heat exchanger 9 and the back-face side heat exchanger 10 becomes possible, and the air merged after having passed through each of the front-face side heat exchanger 9 and the back-face side heat exchanger 10 can be bent at a desired angle. Thus, the flow direction of the air merged after having passed through each of the front-face side heat exchanger 9 and the back-face side heat exchanger 10 can be adjusted to a suitable direction in accordance with a formation position of the blow-out port 3.

The heat exchanger 5 shown in FIG. 10 is constituted by the front-face side heat exchanger 9 and the back-face side heat exchanger 10 formed separately substantially in the inverted V shape, but not limited to this constitution. For example, the shape of the heat exchanger 5 in the right-side longitudinal section may be constituted substantially in the V shape, substantially in the N shape, substantially in the W type, substantially in the inverted N type or substantially in the M type and the like. Also, for example, the front-face side heat exchanger 9 and the back-face side heat exchanger 10 may be constituted by an integral heat exchanger (See FIG. 12). Also, for example, each of the front-face side heat exchanger 9 and the back-face side heat exchanger 10 may be constituted by a combination of a plurality of heat exchangers (See FIG. 12). In the case of the integral heat exchanger, based on the symmetry line 8, the front face side becomes the front-face side heat exchanger 9, while the back face side becomes the back-face side heat exchanger 10. That is, it is only necessary that a length in the longitudinal direction of the heat exchanger arranged on the back face side from the symmetry line 8 is made longer than a length in the longitudinal direction of the heat exchanger arranged on the front face side from the symmetry line 8. Alternatively, if each of the front-face side heat exchanger 9 and the back-face side heat exchanger 10 is constituted by a combination of a plurality of heat exchangers, the sum of the lengths in the longitudinal direction of the plurality of heat exchangers constituting the front-face side heat exchanger 9 becomes the length in the longitudinal direction of the front-face side heat exchanger 9. The sum of the lengths in the longitudinal direction of the plurality of heat exchangers constituting the back-face side heat exchanger 10 becomes the length in the longitudinal direction of the back-face side heat exchanger 10.

Also, it is not necessary to incline all the heat exchangers constituting the heat exchanger 5 in the right-side longitudinal section, but a part of the heat exchangers constituting the heat exchanger 5 may be arranged perpendicularly in the right-side longitudinal section (See FIG. 12).

Also, if the heat exchanger 5 is constituted by a plurality of heat exchangers (if constituted by the front-face side heat exchanger 9 and the back-face side heat exchanger 10, for example), it is not necessary that each heat exchanger is in full contact at a portion (substantial connection portion between the front-face side heat exchanger 9 and the back-face side heat exchanger 10, for example) where arrangement gradient of the heat exchanger 5 is changed, but there may be some gaps.

Also, the shape of the heat exchanger 5 in the right-side longitudinal section may be partially or entirely curved (See FIG. 12).

Embodiment 11

Figure 11:
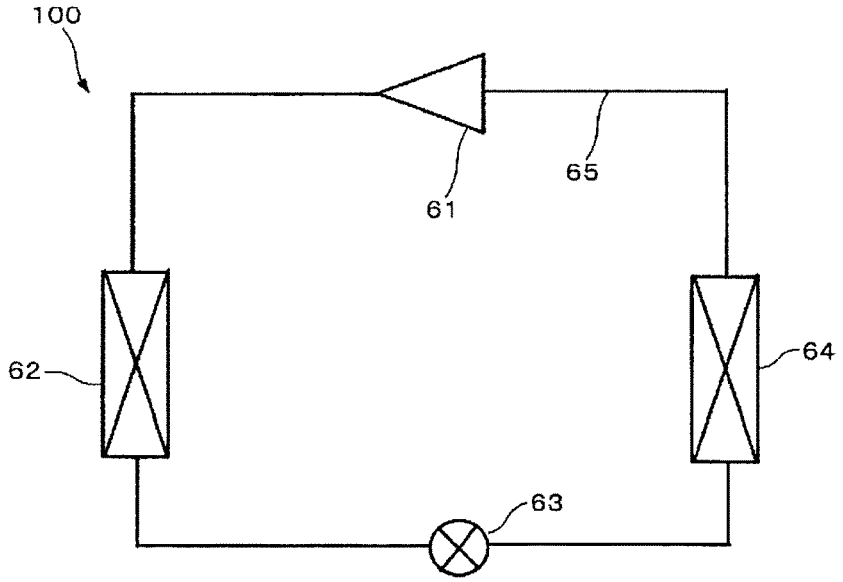
FIG. 11 is an outline configuration diagram illustrating a major refrigerant circuit configuration of an air conditioner 100 according to Embodiment 11.

FIG. 11 is an outline configuration diagram illustrating a major refrigerant circuit configuration of an air conditioner 100 according to Embodiment 11 of the present invention. Based on FIG. 11, a configuration and an operation of the air conditioner 100 will be described. This air conditioner 100 is provided with any of the indoor unit 40 in Embodiment 1 to the indoor unit 50*h* of Embodiment 10. This air conditioner 100 may be any type as long as it is an apparatus using a refrigerating cycle and can be applied to a room air conditioner or the like installed in a house, a building or the like. An indoor heat exchanger 64, which will be described later, is the heat exchanger 5 mounted on any of the indoor unit 40 to the indoor unit 50*h*.

This air conditioner 100 is constituted by sequentially connecting a compressor 61, an outdoor heat exchanger 62, a throttle device 63, and the indoor heat exchanger 64 by a refrigerant piping 65. The compressor 61 sucks the refrigerant flowing through the refrigerant piping 65 and compresses the refrigerant to a high-temperature and high-pressure state. The outdoor heat exchanger 62 functions as a condenser (or a radiator) or an evaporator and performs heat exchange between the refrigerant conducted through the refrigerant piping 65 and a fluid (air, water, refrigerant and the like) and supplies cold energy to the indoor heat exchanger 64. The throttle device 63 decompresses the refrigerant conducted through the refrigerant piping 65 so as to decompress and expand it. This throttle device 63 is preferably constituted by a capillary pipe or an electromagnetic valve and the like. The indoor heat exchanger 64 functions as a condenser (or a radiator) or an evaporator and performs heat exchange between the refrigerant conducted through the refrigerant piping 65 and a fluid.

Here, an operation of the air conditioner 100 will be briefly explained.

[Heating Operation]

The refrigerant which has been compressed by the compressor 61 to high-temperature/high-pressure flows into the indoor heat exchanger 64. In this indoor heat exchanger 64, the refrigerant is heat-exchanged with the fluid and condensed to become low-temperature/high-pressure liquid refrigerant or gas-liquid two-phase refrigerant. At this time, the indoor air is heated to become air for heating. This air for heating has wind direction deviation adjusted by a wind-direction control mechanism of the indoor unit 50 and is sent out to an area to be air-conditioned from the blow-out port 3. The refrigerant flowing out of the indoor heat exchanger 64 is decompressed by the throttle device 63 to become low-temperature/low pressure liquid refrigerant or gas-liquid two-phase refrigerant and flows into the outdoor heat exchanger 62. At the outdoor heat exchanger 62, the refrigerant is heat-exchanged with the fluid to be evaporated and becomes a high-temperature/low-pressure refrigerant gas, which is sucked into the compressor 61 again.

[Cooling Operation]

The refrigerant compressed by the compressor 61 to high-temperature/high-pressure flows into the outdoor heat exchanger 62. At this outdoor heat exchanger 62, the refrigerant is heat-exchanged with the fluid to be condensed and becomes low-temperature/high-pressure liquid refrigerant or gas-liquid two-phase refrigerant. The refrigerant flowing out of the outdoor heat exchanger 62 is decompressed at the throttle device 63 to become low-temperature/low-pressure liquid refrigerant or gas-liquid two-phase refrigerant and flows into the indoor heat exchanger 64. In the indoor heat exchanger 64, the refrigerant is heat-exchanged with the fluid to be evaporated to become a high-temperature/low-pressure refrigerant gas. At this time, the indoor air is cooled to become the air for cooling. This air for cooling has wind direction deviation adjusted by the wind-direction control mechanism of the indoor unit 50 and is sent out from the blow-out port 3 to the area to be air-conditioned. Then, the refrigerant flowing out of the indoor heat exchanger 64 is sucked into the compressor 61 again.

Therefore, the air conditioner 100 has the effect of the indoor unit to be mounted (any of the indoor unit 40 to the indoor unit 50*h*). That is, since the indoor unit mounted on the air conditioner 100 can improve the heat exchange performances of the heat exchanger 5 as mentioned above, the air conditioner 100 will have the improved performances in accordance with that. Also, since the indoor unit mounted on the air conditioner 100 can suppress occurrence of noise and vibrations as mentioned above, user comfort can be improved in accordance with the performances of the air conditioner 100.

Embodiment 12

The following configuration below may be added to the air conditioner (or more specifically, the indoor unit) of Embodiment 1 to Embodiment 11. In Embodiment 12, a difference from Embodiment 1 to Embodiment 11 will be mainly described, and the same reference numerals are given to the same portions as those in Embodiment 1 to Embodiment 11.

<A-1. Configuration>

Figure 13:
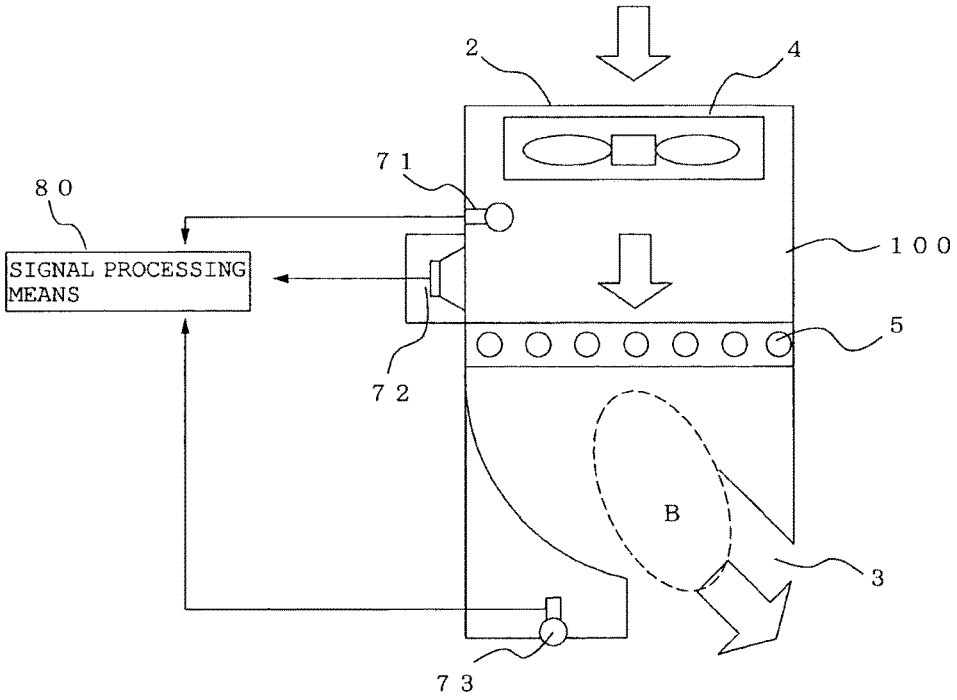
FIG. 13 is a sectional view of a configuration of an air conditioner illustrating Embodiment 12 of the present invention.
Figure 14:
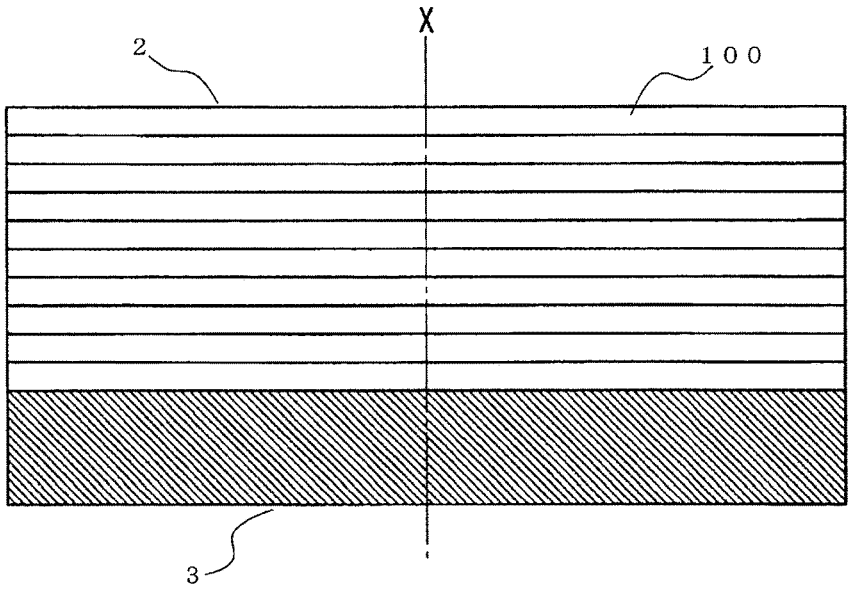
FIG. 14 is a front view of the air conditioner of the present invention.

FIG. 13 is a sectional view of the front view of the air conditioner shown in FIG. 14 cut off in a section X and a diagram illustrating a configuration of the air conditioner in Embodiment 12.

The air conditioner 100 in FIG. 13 constitutes an indoor unit, and the suction port 2 is opened in the upper part of the air conditioner 100, while the blow-out port 3 is opened in the lower end, respectively.

In the air conditioner 100, an air flow passage communicating between the suction port 2 and the blow-out port 3 is formed, the fan 4 constituted by an axial-flow fan having a rotation shaft core in the perpendicular direction is provided below the suction port 2 in the air flow passage, and the heat exchanger 5 for cooling or heating air through heat exchange is arranged further below. By means of an operation of the fan 4, the indoor air is sucked into the air flow passage in the air conditioner 100 through the suction port 2, and this sucked air is cooled or heated by the heat exchanger 5 located at the lower part of the fan 4 and then, blown out into the room through the blow-out port 3.

On a wall portion on the lower side of the fan 4, a noise detection microphone 71 is mounted as noise detecting means for detecting operating sound (noise) of the air conditioner 100 including an air-blowing noise of the fan 4. Below the noise detection microphone 71, a control speaker 72 as control-sound output means for outputting a control sound to the noise is arranged so as to be directed to the center of the air flow passage from the wall. The noise detection microphone 71 and the control speaker 72 are both mounted between the fan 4 and the heat exchanger 5.

Here, the noise detection microphone 71 corresponds to a first sound detecting device of the present invention, while the control speaker 72 to a control sound output device of the present invention.

Moreover, as silencing effect detecting means for detecting noise out of the blow-out port 3 and detecting a silencing effect, a silencing effect detection microphone 73 is mounted on a wall at the lower end of the air conditioner at a position avoiding an air current so that the means is not exposed to the blown-out air from the blow-out port 3.

Here, the silencing effect detection microphone 73 corresponds to a second sound detecting device of the present invention.

Also, output signals of the noise detection microphone 71 and the silencing effect detection microphone 73 are inputted to signal processing means 80 as control sound generating means for generating a signal (control sound) for controlling the control speaker 72.

Here, the signal processing means 80 corresponds to the control sound generating device of the present invention.

Figure 15:
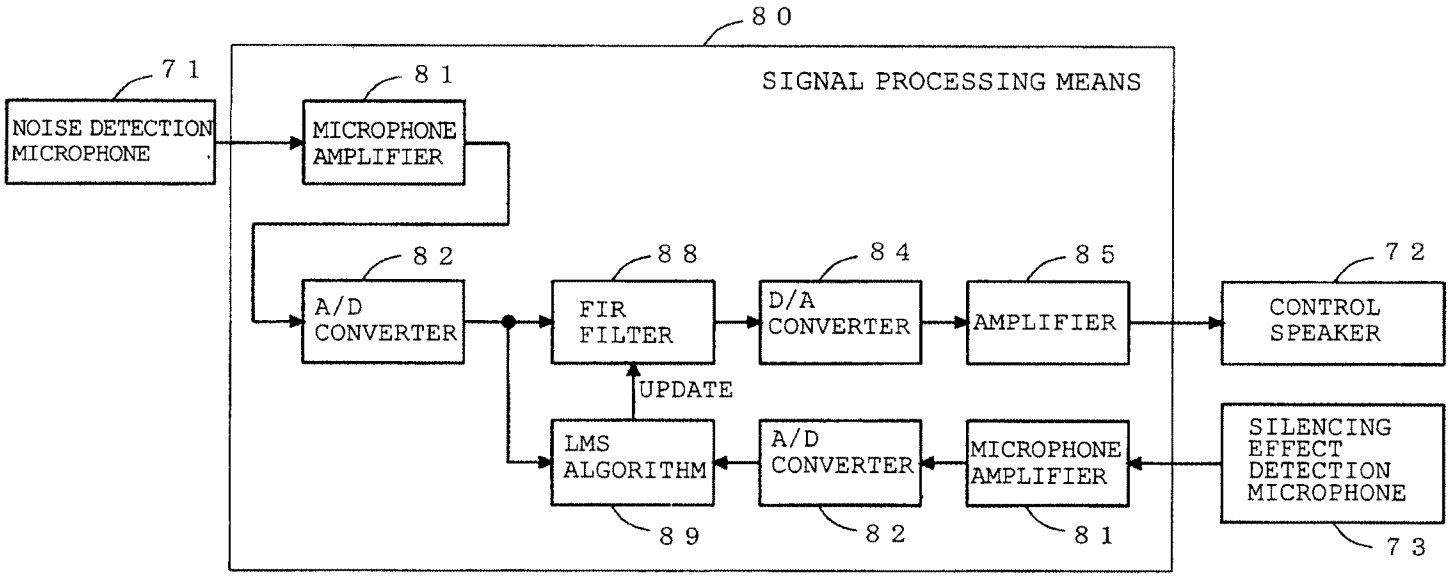
FIG. 15 is a diagram illustrating signal processing means for generating a control sound of Embodiment 12 of the present invention.

FIG. 15 shows a configuration diagram of the signal processing means 80. Electric signals inputted from the noise detection microphone 71 and the silencing effect detection microphone 73 are amplified by a microphone amplifier 81 and converted from an analog signal to a digital signal by an A/D converter 82. The converted digital signal is inputted to an FIR filter 88 and an LMS algorithm 89. In the FIR filter 88, a control signal corrected so that the noise detected by the noise detection microphone 71 has the same amplitude/opposite phase of the noise when the noise reaches a location where the silencing effect detection microphone 73 is installed is generated and converted by the D/A converter 84 from the digital signal to the analog signal, and then, amplified by an amplifier 85 and emitted as a control sound from the control speaker 72.

<A-2. Operation>

Next, the operation of the air conditioner 100 will be described. When the air conditioner 100 is operated, an impeller of the fan 4 is rotated, and the indoor air is sucked from the upper side of the fan 4 and sent to the lower side of the fan 4, by which an air current is generated.

The air current sent by the fan 4 passes through the air flow passage and is sent to the heat exchanger 5. For example, in the case of the cooling operation, in the heat exchanger 5, the refrigerant is sent through a pipe connected to the outdoor unit, not shown in FIG. 13, and when the air current passes through the heat exchanger 5, the air is cooled to become cool air, which is emitted from the blow-out port 3 into the room as it is.

In an area indicated by B in FIG. 13 between the heat exchanger 5 and the blow-out port 3, since the temperature is lowered by the cool air, steam in the air turns into water droplets and then condensation occurs. Thus, though not shown, a water receiver or the like for preventing the water droplets emitted from the blow-out port 3 is mounted in the vicinity of the blow-out port 3 in the air conditioner 100. Since an area on the upstream side of the heat exchanger 5 where the noise detection microphone 71 and the control speaker 72 are arranged is the upstream of the area to be cooled, no condensation occurs.

Next, a method of suppressing the operation sound of the air conditioner 100 will be described. The operation sound (noise) including the air-blowing sound of the fan 4 in the air conditioner 100 is detected by the noise detection microphone 71 mounted between the fan 4 and the heat exchanger 5 and converted to a digital signal through the microphone amplifier 81 and the A/D converter 82 and inputted to the FIR filter 88 and the LMS algorithm 89.

A tap coefficient of the FIR filter 88 is consecutively updated by the LMS algorithm 89. In the LMS algorithm 89, the tap coefficient is updated on the basis of an equation 1 ($h(n+1)=h(n)+2\cdot\mu\cdot e(n)\cdot x(n)$), and an optimal tap coefficient is updated so that an error signal e gets close to zero.

Where h: tap coefficient of the filter, e: error signal, x: filter input signal, and μ: step size parameter, and the step size parameter μ controls a filter coefficient update amount of each sampling.

As mentioned above, the digital signal having passed through the FIR filter 88 whose tap coefficient is updated in the LMS algorithm 89 is converted to an analog signal in the D/A converter 84, amplified by the amplifier 85, and emitted to the air flow passage in the air conditioner 100 as the control sound from the control speaker 72 mounted between the fan 4 and the heat exchanger 5.

On the other hand, at the lower end of the air conditioner 100, by the silencing effect detection microphone 73 mounted in the outer wall direction of the blow-out port 3 so as not to be exposed to the wind emitted from the blow-out port 3, a sound after the control sound emitted from the control speaker 72 is made to interfere with the noise propagated through the air flow passage from the fan 4 and emitted from the blow-out port 3 is detected. Since the sound detected by the silencing effect detection microphone 73 is inputted to the error signal of the above-mentioned LMS algorithm 89, the tap coefficient of the FIR filter 88 is updated so that the sound after the interference gets close to zero. As a result, the noise in the vicinity of the blow-out port 3 can be suppressed by the control sound having passed through the FIR filter 88.

As mentioned above, in the air conditioner 100 to which an active silencing method is applied, by arranging the noise detection microphone 71 and the control speaker 72 between the fan 4 and the heat exchanger 5 and by mounting the silencing effect detection microphone 73 at a location not exposed to the air current from the blow-out port 3, a member required for active silencing does not have to be mounted at the area B where condensation occurs, so that adhesion of water droplets to the control speaker 72, the noise detection microphone 71, and the silencing effect detection microphone 73 can be prevented, and deterioration of silencing performances and failures of the speaker and microphone can be prevented.

Figure 16:
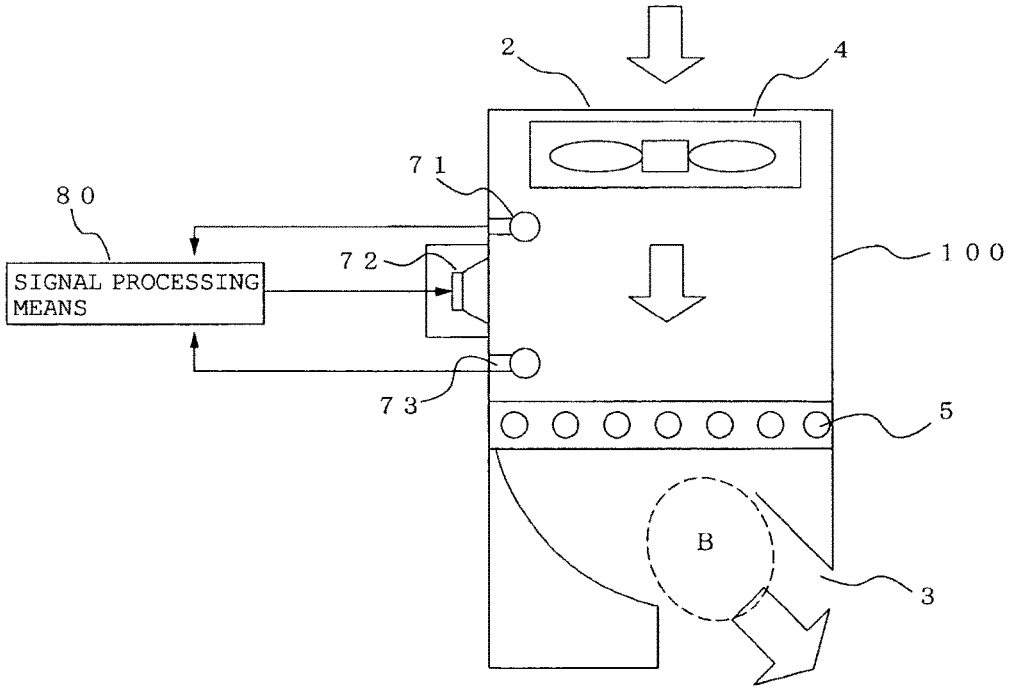
FIG. 16 is a sectional view of a configuration of an air conditioner illustrating another example of Embodiment 12 of the present invention.

In Embodiment 12, the silencing effect detection microphone 73 is installed at a location not exposed to the wind emitted from the blow-out port 3 at the lower end of the air conditioner 100, but as shown in FIG. 16, the microphone may be arranged with the noise detection microphone 71 and the control speaker 72 between the fan 4 and the heat exchanger 5. Moreover, in Embodiment 12, an axial-flow fan is used as an example of the fan 4, but the fan may be any type as long as air is blown by rotation of an impeller like a line-flow fan. Also, the microphone is used as an example of the detecting means for noise and silencing effect after the noise is cancelled by the control sound, but it may be constituted by an acceleration sensor or the like detecting vibration of a housing.

Also, by grasping sound as disturbance in an air flow, the noise and the silencing effect after the noise is cancelled by the control sound may be detected as disturbance in the air flow. That is, as the means for detecting noise and silencing effect after the noise is cancelled by the control sound, a flow-velocity sensor for detecting an air flow, a hot-wire probe and the like may be used. It is also possible to detect the air flow by increasing a gain of the microphone.

Also, for the signal processing means 80 in Embodiment 12, the FIR filter 88 and the LMS algorithm 89 are used, but it may be any type as long as it is an adaptive signal processing circuit to bring the sound detected by the silencing effect detection microphone 73 close to zero, and filtered-X algorithm generally used in an active silencing method may also be used. Moreover, the signal processing means 80 may be configured so as to generate a control sound by a fixed tap coefficient instead of the adaptive signal processing. Also, the signal processing means 80 may be an analog signal processing circuit instead of a digital signal processing.

Moreover, in Embodiment 12, arrangement of the heat exchanger 5 for cooling air in which condensation can occur has been described, but the present invention can be applied to arrangement of the heat exchanger 5 in which condensation will not occur is arranged, and it has an effect to prevent performance deterioration of the noise detection microphone 71, the control speaker 72, the silencing effect detection microphone 73 and the like without considering occurrence of condensation by the heat exchanger 5.

<A-3. Effect>

According to Embodiment 12 of the present invention, in the air conditioner, by providing the fan 4, the heat exchanger 5 arranged on the downstream of the fan 4, the noise detection microphone 71 installed between the fan 4 and the heat exchanger 5 as the noise detecting means for detecting noise, the control speaker 72 installed between the fan 4 and the heat exchanger 5 as control sound output means for outputting the control sound for silencing the noise, the silencing effect detection microphone 9 as silencing effect detecting means for detecting the silencing effect of the control sound, and the signal processing means 80 as the control sound generating means for generating the control sound from the detection results in the noise detection microphone 71 and the silencing effect detection microphone 73, adhesion of water droplets by condensation to the noise detection microphone 71, the control speaker 72 and the like can be prevented, and deterioration of the silencing performances and failures of the microphone, speaker and the like can be prevented. Also, considering transmission of the noise along the air flow, more effective silencing can be realized.

Also, according to Embodiment 12 of the present invention, in the air conditioner, by installing the silencing effect detection microphone 73 as the silencing effect detecting means between the fan 4 and the heat exchanger 5, adhesion of water droplets by condensation to the silencing effect detection microphone 73 is prevented, and deterioration of the silencing performances and failures of the microphone, speaker and the like can be prevented. Also, considering transmission of the noise along the air flow, more effective silencing can be realized.

Also, according to Embodiment 12 of the present invention, in the air conditioner, by installing the silencing effect detection microphone 73 as the silencing effect detecting means on the downstream of the heat exchanger 5 and at a position avoiding the air current, adhesion of water droplets by condensation to the silencing effect detection microphone 73 is prevented, and deterioration of the silencing performances and failures of the microphone, speaker and the like can be prevented. Also, considering transmission of the noise along the air flow, more effective silencing can be realized.

Embodiment 13

<B-1. Configuration>

Figure 17:
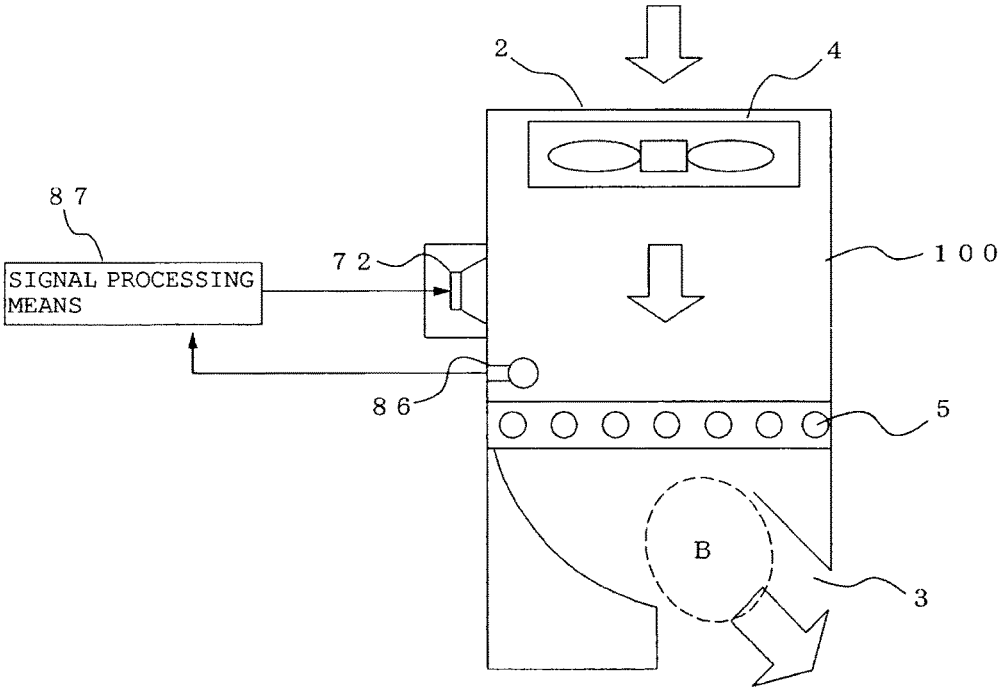
FIG. 17 is a sectional view of a configuration of an air conditioner illustrating Embodiment 13 of the present invention.

In Embodiment 13, the air conditioner in which a noise and silencing effect detection microphone 86 is installed as noise and silencing effect detecting means integrating the noise detection microphone 71 and the silencing effect detection microphone 73 in Embodiment 12 will be described. FIG. 17 is a sectional view cut off in the section X in the front view of the air conditioner 100 shown in FIG. 14 and a diagram illustrating a configuration of the air conditioner in Embodiment 13.

Here, the noise and silencing effect detection microphone 86 corresponds to a sound detecting device of the present invention.

In FIG. 17, the air conditioner 100 constitutes an indoor unit, and the suction port 2 is opened at the upper part of the air conditioner 100, while the blow-out port 3 is opened at the lower end, respectively.

In the air conditioner 100, an air flow passage communicating between the suction port 2 and the blow-out port 3 is formed, the fan 4 constituted by an axial-flow fan having a rotating shaft core in the perpendicular direction is provided below the suction port 2 in the air flow passage, and the heat exchanger 5 for cooling or heating air through heat exchange is arranged further below. By means of the operation of the fan 4, the indoor air is sucked into the air flow passage in the air conditioner 100 through the suction port 2, and this sucked air is cooled or heated by the heat exchanger 5 located at the lower part of the fan 4 and then, blown out into the room through the blow-out port 3.

A difference from the air conditioner 100 described in Embodiment 12 is that in the air conditioner 100 described in Embodiment 12, the control sound is generated in the signal processing means 80 using the two microphones, which are the noise detection microphone 71 and the silencing effect detection microphone 73, for performing the active silencing, but in the air conditioner 100 of Embodiment 13, they are replaced with a noise and silencing effect detection microphone 86, which is a single microphone. Also, with that replacement, since a method of processing signal is different, contents of signal processing means 87 are different.

On a wall portion on the lower side of the fan 4, the control speaker 72 for outputting the control sound for the noise is arranged so as to be directed from the wall to the center of the air flow passage, and further below that, the noise and silencing effect detection microphone 86 is arranged for detecting the sound after the control sound emitted from the control speaker 72 is made to interfere with the noise propagated through the air flow passage from the fan 4 and emitted from the blow-out port 3. The control speaker 72 and the noise and silencing effect detection microphone 86 are mounted between the fan 4 and the heat exchanger 5.

An output signal of the noise and silencing effect detection microphone 86 is inputted to the signal processing means 87 as the control sound generating means for generating a signal (control sound) controlling the control speaker 72.

Figure 18:
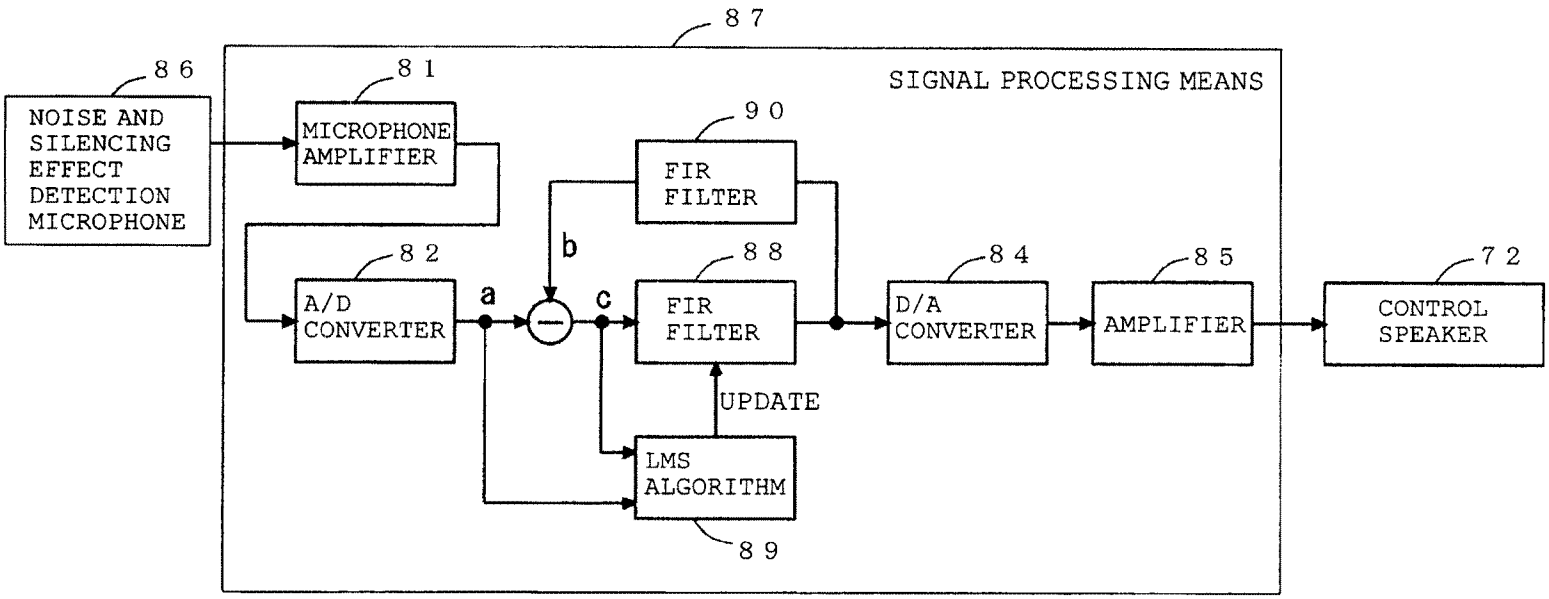
FIG. 18 is a diagram illustrating signal processing means for generating a control sound of Embodiment 13 of the present invention.

FIG. 18 shows a configuration diagram of the signal processing means 87. An electric signal having been converted from a sound signal by the noise and silencing effect detection microphone 86 is amplified by the microphone amplifier 81 and converted from an analog signal to a digital signal by the A/D converter 82. The converted digital signal is inputted to the LMS algorithm 89 and also a differential signal from a signal convolving the FIR filter 90 in the output signal of the FIR filter 88 is inputted to the FIR filter 88 and the LMS algorithm 89. Next, after convolved by the tap coefficient calculated by the LMS algorithm 89 in the FIR filter 88, the differential signal is converted from a digital signal to an analog signal by the D/A converter 84, amplified by the amplifier 85 and emitted from the control speaker 72 as the control sound.

<B-2. Operation>

Next, an operation of the air conditioner 100 will be described. When the air conditioner 100 is operated, the impeller of the fan 4 is rotated, and the indoor air is sucked from the upper side of the fan 4 and sent to the lower side of the fan 4, by which an air current is generated.

The air current sent by the fan 4 passes through the air flow passage and is sent to the heat exchanger 5. For example, in the case of the cooling operation, in the heat exchanger 5, the refrigerant is sent from a pipe connected to the outdoor unit, not shown in FIG. 17, and when the air current passes through the heat exchanger 5, the air is cooled to become cool air, which is emitted from the blow-out port 3 into the room as it is.

In an area indicated by B in FIG. 17 between the heat exchanger 5 and the blow-out port 3, since a temperature is lowered by the cool air, steam in the air turns into water droplets and then condensation occurs. Thus, though not shown, a water receiver or the like for preventing the water droplets from being emitted from the blow-out port 3 is mounted in the vicinity of the blow-out port 3 in the air conditioner 100. Since an area on the upstream side of the heat exchanger 5 where the noise and silencing effect detection microphone 86 and the control speaker 72 are arranged is the upstream of the area to be cooled, no condensation occurs.

Next, a method of suppressing the operation sound of the air conditioner 100 will be described. The sound obtained by having the operation sound (noise) including the air-blowing sound of the fan 4 in the air conditioner 100 interfered with the control sound outputted from the control speaker 72 is detected by the noise and silencing effect detection microphone 86 mounted between the fan 4 and the heat exchanger 5 and converted to a digital signal through the microphone amplifier 81 and the A/D converter 82.

Next, in order to perform a method of suppressing equivalent to the method of suppressing an operation sound described in Embodiment 12, it is necessary that noise to be silenced is inputted to the FIR filter 88, and the sound after the interference between the noise to be silenced to become an input signal and the control sound to become an error signal is inputted to the LMS algorithm 89 as shown in the equation 1. However, since the noise and silencing effect detection microphone 86 can detect only the sound after the interference with the control sound, it is necessary to create noise to be silenced by the sound detected by the noise and silencing effect detection microphone 86.

Figure 19:
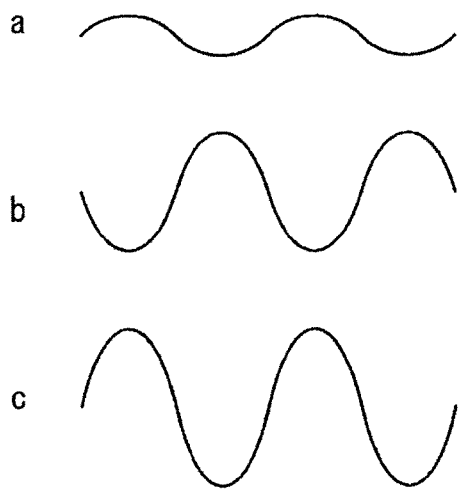
FIG. 19 is a waveform diagram for explaining a method for calculating noise to be silenced from sound after interference.

FIG. 19 shows a waveform of the sound after interference between the noise and the control sound (a in FIG. 19), a waveform of the control sound (b in FIG. 19), and a waveform of the noise (c in FIG. 19). Since b+c=a is obtained from the principle of sound superposition, c can be acquired by taking a difference between a and b. That is, the noise to be silenced can be created from the difference between the sound after the interference detected by the noise and silencing effect detection microphone 86 and the control sound.

Figure 20:
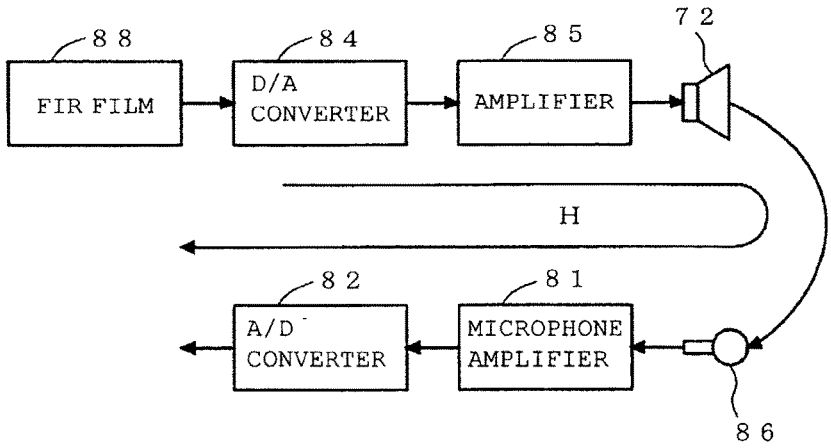
FIG. 20 is a block diagram for explaining a method for estimating the control sound of Embodiment 13 of the present invention.

FIG. 20 is a diagram illustrating a path in which the control signal outputted from the FIR filter 88 becomes the control sound and is outputted from the control speaker 72 and then, detected by the noise and silencing effect detection microphone 86 and inputted to the signal processing means 87. The path goes through the D/A converter 84, the amplifier 85, the path from the control speaker 72 to the noise and silencing effect detection microphone 86, the noise and silencing effect detection microphone 86, the microphone amplifier 81, and the A/D converter 82.

Supposing that transmission characteristics of this path is H, an FIR filter 90 in FIG. 18 estimates the transmission characteristics H. By convolving the FIR filter 90 in the output signal of the FIR filter 88, the control sound can be estimated as the signal b detected by the noise and silencing effect detection microphone 86, and by taking a difference with the sound a after the interference detected by the noise and silencing effect detection microphone 86, the noise c to be silenced is generated.

The noise c to be silenced which has been generated as above is supplied as an input signal to the LMS algorithm 89 and the FIR filter 88. The digital signal having passed the FIR filter 88 whose tap coefficient was updated in the LMS algorithm 89 is converted to an analog signal in the D/A converter 84, amplified by the amplifier 85, and emitted to the air flow passage in the air conditioner 100 as the control sound from the control speaker 72 mounted between the fan 4 and the heat exchanger 5.

On the other hand, in the noise and silencing effect detection microphone 86 mounted below the control speaker 72, the sound after having the noise propagated through the air flow passage from the fan 4 and emitted from the blow-out port 3 interfered with the control sound emitted from the control speaker 72 is detected. Since the sound detected by the noise and silencing effect detection microphone 86 is inputted to the error signal of the above-mentioned LMS algorithm 89, the tap coefficient of the FIR filter 88 is updated so that the sound after the interference gets close to zero. As a result, the noise in the vicinity of the blow-out port 3 can be suppressed by the control sound having passed through the FIR filter 88.

As mentioned above, in the air conditioner 100 to which the active silencing method is applied, by arranging the noise and silencing effect detection microphone 86 and the control speaker 72 between the fan 4 and the heat exchanger 5, it is no longer necessary to mount a member required for active silencing at the area B where condensation occurs, so that adhesion of water droplets to the control speaker 72 and the noise and silencing effect detection microphone 86 can be prevented and deterioration in the silencing performances and failures of the speaker and microphone can be prevented.

Figure 21:
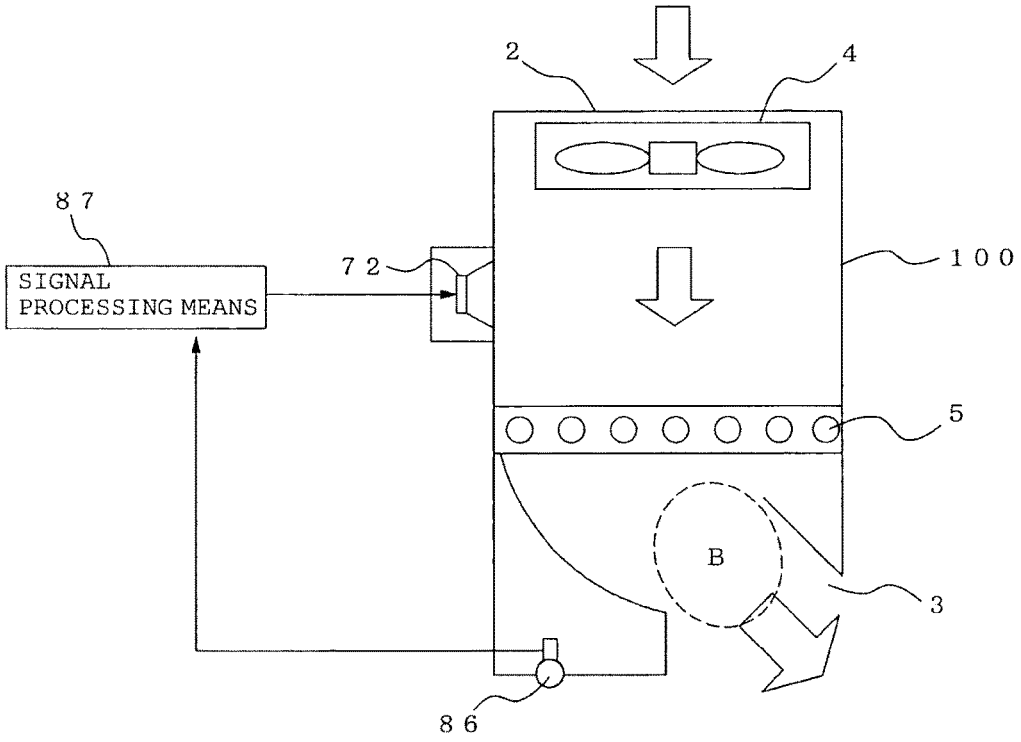
FIG. 21 is a sectional view of a configuration of an air conditioner illustrating another example of Embodiment 13 of the present invention.

In Embodiment 13, the noise and silencing effect detection microphone 86 is arranged on the upstream side of the heat exchanger 5, but as in FIG. 21, the microphone may be installed at the lower end of the air conditioner 100 at a location (position avoiding an air current) not exposed to wind emitted from the blow-out port 3. Moreover, in Embodiment 13, an axial-flow fan is used as an example of the fan 4, but the fan may be any type as long as air is blown by the rotation of an impeller like a line-flow fan. Also, the microphone is used as an example of the means for detecting noise and silencing effect after the noise is cancelled by the noise and the control sound, but it may be constituted by an acceleration sensor or the like detecting the vibration of a housing.

Also, by grasping sound as disturbance in an air flow, the noise and the silencing effect after the noise is cancelled by the control sound may be detected as disturbance in the air flow. That is, as the means for detecting noise and silencing effect after the noise is cancelled by the control sound, a flow-velocity sensor for detecting an air flow, a hot-wire probe and the like may be used. It is also possible to detect the air flow by increasing the gain of the microphone.

In the signal processing means 87, in Embodiment 13, the FIR filter 88 and the LMS algorithm 89 are used as an adaptive signal processing circuit, but it may be any adaptive signal processing circuit that brings the sound detected by the noise and silencing effect detection microphone 86 close to zero. Moreover, the signal processing means 87 may be configured so as to generate a control sound by a fixed tap coefficient instead of the adaptive signal processing. Also, the signal processing means 87 may be an analog signal processing circuit instead of the digital signal processing.

Moreover, in Embodiment 13, arrangement of the heat exchanger 5 for cooling air in which condensation can occur is described, but the present invention can be applied to arrangement of the heat exchanger 5 in which condensation will not occur, and it has an effect to prevent performance deterioration of the noise and silencing effect detection microphone 16, the control speaker 72 and the like without considering occurrence of condensation by the heat exchanger 5.

<B-3. Effect>

According to Embodiment 13 of the present invention, in the air conditioner, by providing the fan 4, the heat exchanger 5 installed on the downstream of the fan 4, the noise and silencing effect detection microphone 16 installed between the fan 4 and the heat exchanger 5 as the noise and silencing effect detecting means for detecting noise and a silencing effect of the control sound silencing the noise, the control speaker 72 installed between the fan 4 and the heat exchanger 5 as control sound output means for outputting the control sound, and the signal processing means 87 as the control sound generating means for generating the control sound from the detection result of the noise and silencing effect detection microphone 16, adhesion of water droplets by condensation to the noise and silencing effect detection microphone 16, the control speaker 72 and the like can be prevented, and deterioration of the silencing performances and failures of the microphone, speaker and the like can be prevented. Also, a more inexpensive system can be constituted by decreasing the number of microphones.

Also, according to Embodiment 13 of the present invention, in the air conditioner, by installing the noise and silencing effect detection microphone 16 as the noise and silencing effect detecting means on the downstream of the heat exchanger 5 and at a position avoiding the air current, adhesion of water droplets by condensation to the noise and silencing effect detection microphone 16 is prevented, and deterioration of the silencing performances and failures of the microphone, speaker and the like can be prevented. Also, a more inexpensive system can be constituted by decreasing the number of microphones.

Figure 22:
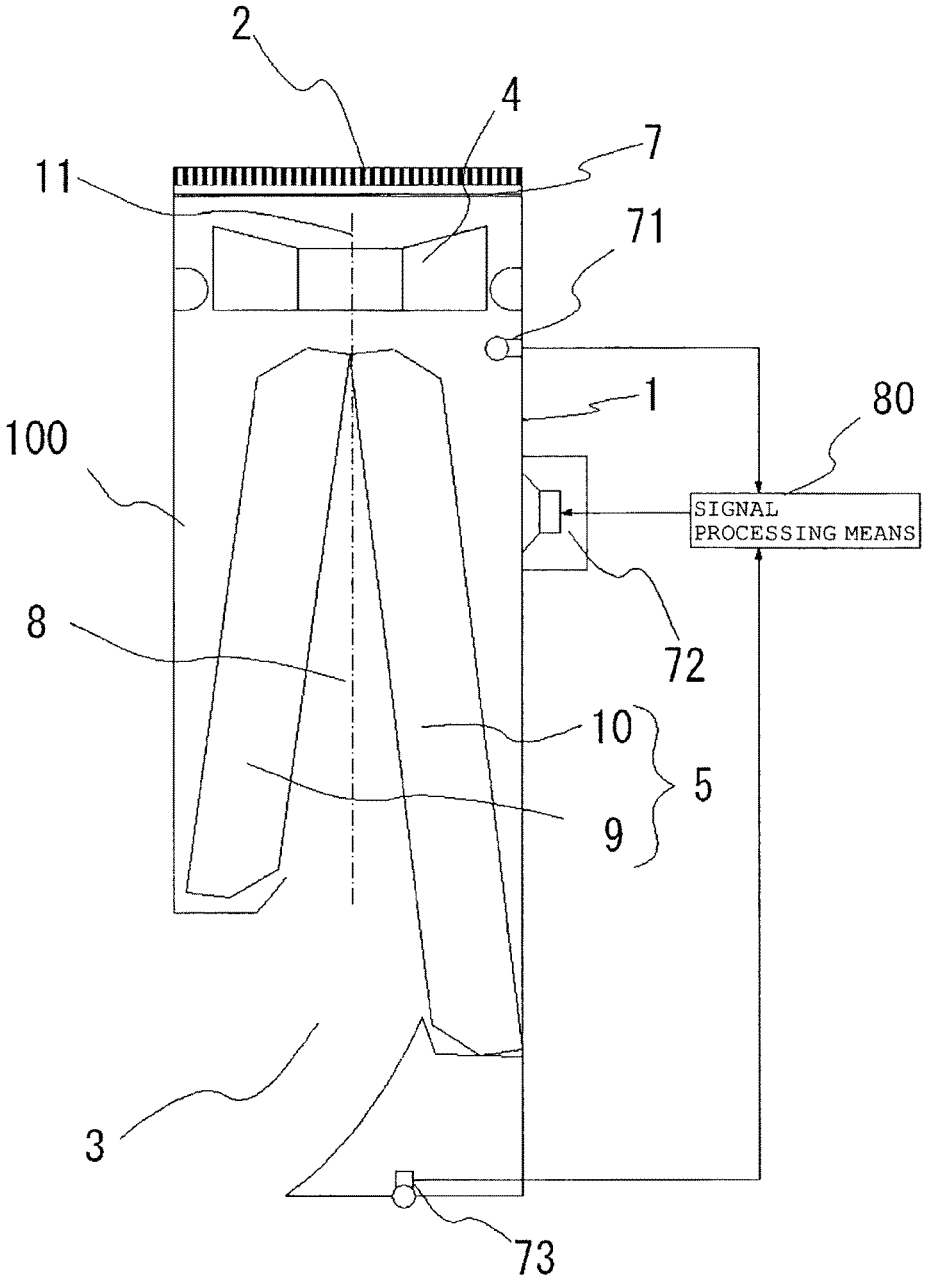
FIG. 22 is a diagram illustrating an example in which a structure of the heat exchanger shown in FIG. 5 is employed in FIG. 13.
Figure 23:
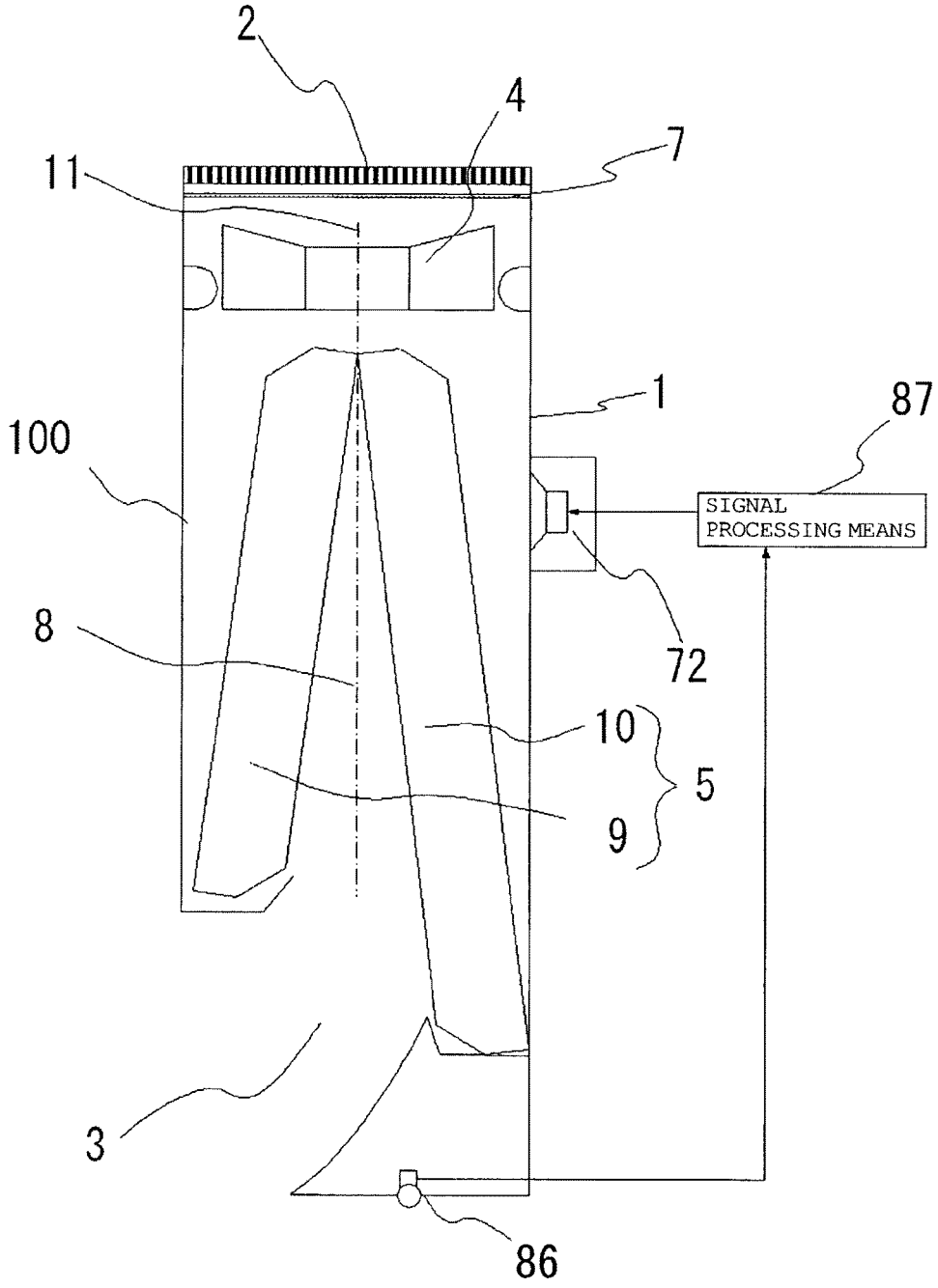
FIG. 23 is a diagram illustrating an example in which a structure of the heat exchanger shown in FIG. 5 is employed in FIG. 21.

FIGS. 13 to 21 show the structure of the heat exchanger 5 shown in FIG. 1 as the structure of the heat exchanger 5, but it is needless to say that the structure of the heat exchanger 5 shown in each of FIGS. 2 to 8 may be employed as the structure of the heat exchanger 5 shown in FIGS. 13 to 21. For example, FIG. 22 is a diagram exemplifying the case in which the structure of the heat exchanger 5 shown in FIG. 5 is employed as the structure of the heat exchanger 5 shown in FIG. 13, and FIG. 23 is a diagram exemplifying the case in which the structure of the heat exchanger 5 shown in FIG. 5 is employed as the structure of the heat exchanger 5 shown in FIG. 21. Also, it is needless to say that if the structure of the heat exchanger 5 shown in FIGS. 2 to 8 is employed in FIGS. 13 to 21, air-volume distribution according to the heat transfer areas may be carried out in accordance with the position of the fan as shown in Embodiments 9 and 10.

EXPLANATION OF NUMERAL REFERENCES

1 casing, 2 suction port, 3 blow-out port, 4 fan, 5 heat exchanger, 6 finger guard, 7 filter, 8 symmetry line, 9 front-face side heat exchanger, 9*a* heat exchanger, 9*b* heat exchanger, 10 back-face side heat exchanger, 10*a* heat exchanger, 10*b* heat exchanger, 11 rotating shaft, 40 indoor unit, 50 indoor unit, 50*a* indoor unit, 50*b* indoor unit, 50*c* indoor unit, 50*d* indoor unit, 50*e* indoor unit, 50*f* indoor unit, 50*g* indoor unit, 50*h* indoor unit, 61 compressor, 62 outdoor heat exchanger, 63 throttle device, 64 indoor heat exchanger, 65 refrigerant piping, 71 noise detection microphone, 72 control speaker, 73 silencing effect detection microphone, 80 signal processing means, 81 microphone amplifier, 82 A/D converter, 84 D/A converter, 85 amplifier, 86 noise and silencing effect detection microphone, 87 signal processing means, 88, 90 FIR filter, 89 LMS algorithm, 100 air conditioner

The invention claimed is:

1. An indoor unit of an air conditioner comprising:

a casing having an upper part and a lower side opposite the upper part, the casing further having a suction port formed in the upper part and a blow-out port formed at the lower side of a front face part, wherein air flows in an air flow direction from upstream to downstream through said casing, from said suction port to said blow-out port, the casing yet further having a front face part and a back face part opposite the front face part, the front face part and the back face part extending between said upper part and said lower side;

an axial-flow or diagonal-flow blower provided on a downstream side of said suction port in said casing in the air flow direction; and a heat exchanger provided on a downstream side of said axial-flow or diagonal-flow blower and on an upstream side of said blow-out port in said casing in the air flow direction, said heat exchanger being configured to exchange heat between air blown out of said axial-flow or diagonal-flow blower and refrigerant, wherein said heat exchanger includes a front-face side heat exchanger arranged at a front face side of said casing relative to a line of symmetry of said casing extending from the upper part to the lower side, wherein the front-face side heat exchanger comprises two exchanger units, each of said heat exchanger units of the front-face side heat exchanger taking the form of an elongated quadrilateral in longitudinal section, wherein lines extending along the direction of elongation of each of the respective quadrilaterals, and at the centers of the respective quadrilaterals, together form a V-shape, and a back-face side heat exchanger arranged at a back-face side of said casing relative to the line of symmetry of said casing, wherein the back-face side heat exchanger comprises two heat exchanger units forming a V-shape, each of said heat exchanger units of the back-face side heat exchanger taking the form of an elongated quadrilateral in longitudinal section, wherein lines extending along the direction of elongation of each of the respective quadrilaterals, and at the centers of the respective quadrilaterals of the front-face side heat exchanger and the back-face side heat exchanger together form a W-shape, wherein an upper end portion of a back-most heat exchanger unit of the V-shape back-face side heat exchanger is positioned higher than an upper end portion of a front-most heat exchanger unit of the V-shape back-face side heat exchanger, wherein said heat exchanger is configured so that a flow volume of air flowing through said front-face side heat exchanger is smaller than a flow volume of air flowing through said back-face side heat exchanger, and said axial-flow or diagonal-flow blower is provided only at the upstream side of said heat exchanger in the air flow direction, wherein no blower is present downstream of the heat exchanger in the air flow direction, and adjacent the blow-out port.

2. The indoor unit of the air conditioner of claim 1, wherein on a side view, a length in a longitudinal direction of said front-face side heat exchanger is shorter than a length in a longitudinal direction of said back-face side heat exchanger.

3. The indoor unit of the air conditioner of claim 1, wherein pressure loss of said front-face side heat exchanger is larger than pressure loss of said back-face side heat exchanger.

4. The indoor unit of the air conditioner of claim 1, wherein said front-face side heat exchanger is arranged so that air flows from the front face side to the back face side; and said back-face side heat exchanger is arranged so that air flows from the back face side to the front face side.

5. The indoor unit of the air conditioner of claim 1, wherein said axial-flow or diagonal-flow blower is arranged so that air volumes in accordance with a heat transfer area of said front-face side heat exchanger and a heat transfer area of said back-face side heat exchanger are supplied to said front-face side heat exchanger and said back-face side heat exchanger.

6. The indoor unit of the air conditioner of claim 5, wherein a rotating shaft of said axial-flow or diagonal-flow blower is arranged above the heat exchanger having a larger heat transfer area between said front-face side heat exchanger and said back-face side heat exchanger.

7. The indoor unit of the air conditioner of claim 5, wherein a rotating shaft of said axial-flow or diagonal-flow blower is arranged so as to be directed to a heat exchanger having a larger heat transfer area among said front-face side heat exchanger and said back-face side heat exchanger.

8. The indoor unit of the air conditioner of claim 1, further comprising:

a first sound detecting device installed at a position between said blower and said heat exchanger and detecting a sound at the position;

a current sound output device installed between said blower and said heat exchanger and outputting a control sound;

a second sound detecting device installed at a position on the downstream side of said blower and detecting sound at the position; and a control sound generating device for generating said control sound on the basis of the detected results of said first sound detecting device and said second sound detecting device.

9. The indoor unit of the air conditioner of claim 8, wherein said second sound detecting device is arranged between said blower and said heat exchanger.

10. The indoor unit of the air conditioner of claim 8, wherein said second sound detecting device is arranged on the downstream side of said heat exchanger.

11. The indoor unit of the air conditioner of claim 1, further comprising:

a control sound output device installed between said blower and said heat exchanger and outputting a control sound;

a sound detecting device installed at a position on the downstream side of said blower and detecting sound at the position; and a control sound generating device for generating said control sound on the basis of the detected result of said sound detecting device.

12. The indoor unit of the air conditioner of claim 11, wherein said sound detecting device is installed between said blower and said heat exchanger.

13. The indoor unit of the air conditioner of claim 11, wherein said sound detecting device is installed on the downstream side of said heat exchanger.

14. An air conditioner comprising the indoor unit of claim 1.

15. The indoor unit of the air conditioner of claim 1, wherein the indoor unit is a wall-mounted indoor unit, and air is blown out through said blow-out port to a front side of said casing.

16. The indoor unit of the air conditioner of claim 1, wherein the blower rotates about a rotation axis on a front/back line of symmetry of the casing.

17. The indoor unit of the air conditioner of claim 16, wherein the V-shapes forming the W-shape are joined at a point on the front/back line of symmetry of the casing.

* * * * *